US006235076B1

(12) United States Patent
Ozaki et al.

(10) Patent No.: US 6,235,076 B1
(45) **Date of Patent: *May 22, 2001**

(54) IRON BASE POWDER MIXTURE FOR POWDER METALLURGY EXCELLENT IN FLUIDITY AND MOLDABILITY, METHOD OF PRODUCTION THEREOF, AND METHOD OF PRODUCTION OF MOLDED ARTICLE BY USING THE IRON BASE POWDER MIXTURE

(75) Inventors: Yukiko Ozaki; Satoshi Uenosono; Kuniaki Ogura, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/171,911

(22) PCT Filed: Mar. 18, 1998

(86) PCT No.: PCT/JP98/01147

§ 371 Date: Oct. 28, 1998

§ 102(e) Date: Oct. 28, 1998

(87) PCT Pub. No.: WO98/41347

PCT Pub. Date: Sep. 24, 1998

(30) Foreign Application Priority Data

Mar. 19, 1997 (JP) ..... 9-066767

(51) Int. Cl.[7] ..... B22F 1/00
(52) U.S. Cl. ..... 75/252
(58) Field of Search ..... 75/252

(56) References Cited

U.S. PATENT DOCUMENTS

| | | | |
|---|---|---|---|
| 2,717,419 | 9/1955 | Dickey . | |
| 3,351,464 | 11/1967 | Budincsevits . | |
| 3,410,684 | 11/1968 | Printz . | |
| 4,721,599 | 1/1988 | Nakamura . | |
| 4,737,332 | 4/1988 | Miyashita et al. . | |
| 4,765,950 | 8/1988 | Johnson . | |
| 4,955,798 | 9/1990 | Musella et al. . | |
| 5,069,714 | 12/1991 | Gosselin . | |
| 5,154,881 | 10/1992 | Rutz et al. . | |
| 5,256,185 | 10/1993 | Semel et al. | 75/255 |
| 5,271,891 | 12/1993 | Gay et al. . | |
| 5,368,630 | 11/1994 | Luk | 75/252 |
| 5,989,304 * | 11/1999 | Ozaki et al. | 75/252 |
| B1 4,955,798 | 3/1999 | Musella et al. . | |

FOREIGN PATENT DOCUMENTS

| | | |
|---|---|---|
| 26 43 954 A1 | 3/1978 | (DE) . |
| 0 029389 | 5/1981 | (EP) . |
| 0 375 627 B1 | 5/1993 | (EP) . |
| 56-136901 | 10/1981 | (JP) . |
| 61-186433 | 8/1986 | (JP) . |
| 62-282418 | 12/1987 | (JP) . |
| 1-165701 | 6/1989 | (JP) . |
| 1-255602 | 10/1989 | (JP) . |
| 2-47201 | 2/1990 | (JP) . |
| 2-57602 | 2/1990 | (JP) . |
| 2-156002 | 6/1990 | (JP) . |
| 3-162502 | 7/1991 | (JP) . |
| 3-226501 | 10/1991 | (JP) . |
| 4-56702 | 2/1992 | (JP) . |
| 5-192796 | 8/1993 | (JP) . |
| 5-271709 | 10/1993 | (JP) . |
| 6-172805 | 6/1994 | (JP) . |
| 7-504715 | 5/1995 | (JP) . |
| 7-508076 | 9/1995 | (JP) . |
| 7-103404 | 11/1995 | (JP) . |
| 9-104901 | 4/1997 | (JP) . |

OTHER PUBLICATIONS

*Höganäs Iron Powder Handbook*, vol. I: Basic Information (1957).

Mettalurgia, *The Effect of Lubricant Content on the Packing of Metal Powders*, D. Yarnton and T.J. Davies (Oct. 1962).

Engineering Materials and Design, *Power Technology —Effect of Lubricant on the Flow and Packing Density of Copper Powder*, D. Yarnton and T.J. Davies (1970).

Jernkontorets Forskning, *Powder Flow Properties and Conditioning Agents*, A. Taskinen, H. Tonteri and L. Holappa, Research Project n:o 2504/82 (1983).

* cited by examiner

*Primary Examiner*—Ngoclan Mai
(74) *Attorney, Agent, or Firm*—Austin R. Miller

(57) ABSTRACT

The present invention intends to provide an iron-based powder composition for powder metallurgy having excellent flowability at room temperature and a warm compaction temperature, having improved compactibility enabling lowering ejection force in compaction, to provide a process for producing the iron-based powder composition, and to provide a process for producing a compact of a high density from the iron-based powder composition. The iron-based powder composition comprises an iron-based powder, a lubricant, and an alloying powder, and at least one of the iron-based powder, the lubricant, and the alloying powder is coated with at least one surface treatment agent selected from the group of surface treatment agents of organoalkoxysilanes, organosilazanes, titanate coupling agents, fluorine-containing silicon silane coupling agents. The iron-based powder composition is compacted at a temperature not lower than the lowest melting point of the employed lubricants, but not higher than the highest melting point of the employed lubricants.

16 Claims, No Drawings

IRON BASE POWDER MIXTURE FOR POWDER METALLURGY EXCELLENT IN FLUIDITY AND MOLDABILITY, METHOD OF PRODUCTION THEREOF, AND METHOD OF PRODUCTION OF MOLDED ARTICLE BY USING THE IRON BASE POWDER MIXTURE

TECHNICAL FIELD

The present invention relates to an iron-based powder composition for powder metallurgy comprising an iron-based powder such as iron powders and alloy steel powders; an alloying powder such as graphite powder, and copper powder; and a lubricant. More particularly the present invention relates to an iron-based powder composition for powder metallurgy which causes less particle segregation of the additive and less generation of dust, and has excellent flowability and compactibility over a broad temperature range from room temperature to about 200° C. The present invention relates also to a process for production of the iron-based powder composition and a process for production of a compact from the composition.

BACKGROUND ART

Iron-based powder compositions for powder metallurgy have been produced generally by mixing an iron powder as the base material, and an alloying powder such as copper powders, graphite powders, and iron phosphide powders, and, if necessary, a machinability-improving powder, and a lubricant such as zinc stearate, aluminum stearate, and lead stearate. The lubricant has been selected in consideration of its mixability with the iron powder and its removability in the sintering process.

In recent years, in powder metallurgy, sintered members are demanded to have higher strength. To meet the demand, a "warm compaction technique" has been developed in which powdery material filled in a metal die is compacted with heating at a certain temperature to obtain a compact having a higher density and a higher strength (See, for example, Japanese Patent Application Laid-Open Gazette (Kokai) No. Hei.2-156002, Japanese Patent Publication (Kokoku) No. Hei.7-103404, U.S. Pat. No. 5,256,185, and U.S. Pat. No. 5,368,630). The lubricant added to the iron powder in the warm compaction technique should have lubricity in the compaction process in addition to the above required properties. This lubricity is important to improve the compactibility by reducing frictional resistance between the iron powder particles and between the metal die and the formed compact by melting a part or the entire of the lubricant and dispersing it uniformly throughout the iron powder particle interspace. However, a conventional powder mixture is liable to cause particle segregation of an alloying powder or other additive disadvantageously. A powder mixture generally contains powder particles having various particle sizes, various particle shapes, and different particle densities, so that segregation tends to occur during transportation after the mixing, on charging into or discharging from a hopper, or during compacting.

For example, a mixture of iron-based powder and graphite powder is known to undergo particle segregation during truck transportation by vibration in a transporting vessel to separate graphite particles on the powder surface. A powder composition charged into a hopper undergoes segregation during movement within the hopper, causing variation of graphite powder content in the discharged powder composition from the initial stage to the end stage of the discharge.

The final sintered articles produced from the segregated nonuniform powder composition are liable to vary in chemical composition, dimension, and strength, which can make the products inferior. The graphite powder or an additive, which is usually fine powdery, increases the specific surface area of the powder composition to lower the flowability of the composition. The lower flowability of the composition decreases the speed of filling the powder composition into a die cavity, lowering the compact production rate.

For preventing the segregation of the powder composition, addition of a binder is disclosed in Japanese Patent Application Laid-Open Gazette Nos. Sho.56-136901 and Sho.58-28321. However, a larger amount of addition of a binder to prevent the segregation in the powder composition poses another problem of fall of the flowability of the entire powder composition disadvantageously.

The inventors of the present invention disclosed use of a co-melted mixture of a metal soap or a wax and an oil as a binder in Japanese Patent Application Laid-Open Gazette Nos. Hei.1-165701 and Hei.2-47201. The disclosed binder reduces remarkably the segregation of the powder composition and the scattering of dust, and improves the flowability. However, this technique poses another problem of variation of the flowability of the powder composition with lapse of time owing to the above method of segregation prevention, namely the increase of the amount of the binder.

The inventors of the present invention disclosed use of a co-melted mixture of a high-melting oil and a metal soap as a binder in Japanese Patent Application Laid-Open Gazette No. Hei.2-57602. This technique reduces deterioration with time of the properties of the co-melted mixture and deterioration with time of flowability of the powder composition. This technique, however, poses still another problem such that the apparent density of the powder composition changes because a high-melting saturated fatty acid in a solid state and a metal soap are mixed with the iron-based powder. To solve this problem, the inventors of the present invention disclosed, in Japanese Patent Application Laid-Open Gazette No. Hei.3-162502, a method in which the surface of the iron-based powder particles is coated with a fatty acid, an alloying powder or a like additive is allowed to adhere thereto through a co-melted mixture of a fatty acid and a metal soap, and then a metal soap is added onto the outer surface thereof.

The above techniques disclosed in Japanese Patent Application Laid-Open Gazette Nos. Hei.2-57602 and Hei.3-162502 solve the problems of segregation in the powder composition and generation of dust to a considerable extent. With this technique, however, the flowability of the powder composition is insufficient: especially the flowability in "warm compaction" in which the powder composition heated to about 150° C. is filled in a hot die and is compacted. Further, the improvements of compactibility of the powder composition in warm compaction disclosed in Japanese Patent Application Laid-Open Gazette Nos. Hei.2-156002, and Hei.7-103404, U.S. Pat. No. 5,256,185, and U.S. Pat. No. 5,368,630 mentioned above are not sufficient in the flowability of the powder composition in warm compaction owing to liquid bridge formation by a low-melting lubricant component between particles. The insufficient flowability not only reduces the productivity of the compacts but also causes variation of the density of the compacts and variation of the properties of the final sintered products. Furthermore, the warm compaction technique disclosed in above Japanese Patent Application Laid-Open Gazette No. Hei.2-156002, etc. enables production of iron-based compact having high density and high strength, but requires stronger ejection force for removal of the compact from the die and is liable to cause scratches on the compact surface or to shorten the life of the die.

The present invention intends to provide an iron-based powder composition for powder metallurgy excellent in flowability and compactibility in comparison with conventional ones at room temperature and in warm compaction, and intends also to provide a process for producing the powder composition, and a process for producing a compact having a higher density and a higher strength.

DISCLOSURE OF THE INVENTION

Flowability of metal powder is extremely impaired generally by addition of a lubricant or a like organic material. The inventors of the present invention made investigation on this problem, and found that frictional resistance and adhesive force between the metal powder and the organic material impairs the flowability. Therefore, the inventors made comprehensive study on reduction of the frictional force and the adhesive force, and found that the frictional resistance can be reduced by surface treatment (coating) of the metal powder particles with a certain organic material which is stable up to the warm compaction temperature (about 200° C.), and that the adhesion by electrostatic force can be decreased by bringing the surface potential of the metal powder particles to the surface potential of the organic material (except the above surface treating material) to retard contact electrification between different kind of particles on mixing.

Further, the inventors of the present invention made investigation on solid lubricants for improvement of compactibility of a powder composition, and found that the force for removing a compact from a die after compaction (hereinafter referred to as ejection force) can be reduced to improve compact productivity by use of an organic or inorganic compound having a layer crystal structure in a temperature range from room temperature to warm compaction temperature, or by use of a thermoplastic resin or elastomer capable of undergoing plastic deformation at a temperature higher than 100° C. in warm compaction. They also found that the coating of the metal powder surface with the above surface treating material for flowability improvement reduces secondarily the ejection force to improve the compactibility. The present invention has been accomplished on the basis of the above findings.

The present invention provides an iron-based powder composition for powder metallurgy having higher flowability and higher compactibility, comprising an iron-based powder, a lubricant, and an alloying powder, at least one of the iron-based powder, the lubricant, and the alloying powder being coated with at least one surface treatment agent selected from the group of surface treatment agents below:

Surface Treatment Agents

Surface treatment agents: organoalkoxysilanes, organosilazanes, titanate coupling agents, fluorine-containing silicon silane coupling agents.

The present invention provides also an iron-based powder composition for powder metallurgy having higher flowability and higher compactibility, comprising an iron-based powder, a lubricant fixed by melting to the iron-based powder, an alloying powder fixed to the iron-based powder by the lubricant, and a free lubricant powder, at least one of the iron-based powder, the lubricant, and the alloying powder being coated with at least one surface treatment agent selected from the group shown above.

The surface treatment agent selected from the above group may be replaced by a mineral oil or silicone fluid in the present invention. The mineral oil is preferably an alkylbenzene.

The iron-based powder as the base in the present invention includes pure iron powder such as atomized iron powder, and reduced iron powder; partially diffusion-alloyed steel powder; and completely alloyed steel powder. The partially diffusion-alloyed steel powder is preferably a steel powder alloyed partially with one or more of Cu, Ni, and Mo. The completely alloyed steel powder is preferably a steel powder alloyed with Mn, Cu, Ni, Cr, Mo, V, Co, and W.

The alloying powder includes graphite powders, copper powders, and cuprous oxide powders as well as MnS powders, Mo powders, Ni powders, B powders, BN powders, and boric acid powders. The alloying powder may be used singly or in combination of two or more thereof. Graphite powders, copper powders, and cuprous oxide powders are especially preferred since they increase the strength of the sintered article as the final product. The alloying powder is incorporated into the composition at a content ranging from 0.1 to 10 wt % relative to the iron-based powder (100 wt %), since the final sintered article has excellent strength at a content of 0.1 wt % or more of the graphite powder; a powder of a metal such as Cu, Mo, and Ni; or a boron powder, but impairs dimensional accuracy of the final sintered product at a content of higher than 10 wt %.

The aforementioned organoalkoxysilane as the surface treatment agent is a substance having a structure of $R_{4-m}Si—(OC_nH_{2n+1})_m$ (where R is an organic group, n and m are respectively an integer, and m=1–3). The organic group R may have a substituent or be not substituted. In the present invention, the organic group R preferably has no substituent. The substituent is preferably selected from the groups of acryl, epoxy, and amino.

The organosilazane includes those represented by any of the general formulas: $R_nSi(NH_2)_{4-n}$, $(R_3Si)_2NH$, $R_3SiNH(R_2SiNH)_nSiR_3$, $(R_2SiNH)_n$, and $R_3SiNH(R_2SiNH)_nSiR_3$.

The lubricant in the present invention is a fatty acid amide and/or a metal soap. This lubricant prevents surely segregation of the iron-based powder composition and dust generation, and improves flowability and compactibility. The fatty acid amide is contained preferably at a content of from 0.01 to 1.0 wt %, and the metal soap is preferably contained at a content from 0.01 to 1.0 wt % based on the weight of the powder composition. The fatty acid amide includes ethylenebis(stearamide), and bis-fatty acid amides. The metal soap includes calcium stearate, and lithium stearate.

The lubricant also includes inorganic compounds having a layer crystal structure, organic compounds having a layer crystal structure, thermoplastic resins, and thermoplastic elastomers. The lubricant may be employed singly or in combination of two or more thereof. The inorganic compound having a layer crystal structure is preferably one or more of graphite, carbon fluoride, and $MOS_2$. The organic compound having a layer crystal structure is selected from melamine-cyanuric acid adduct (MCA) and β-alkyl-N-alkylaspartic acid. The thermoplastic resin is preferably one or more selected from polystyrene, nylon, and fluoroplastics in a powder state having a particle size of not more than 30 μm. The thermoplastic elastomer is preferably in a powder state having a particle size of not more than 30 μm. The thermoplastic elastomer is more preferably one or more materials selected from styrene block copolymer (SBC), thermoplastic elastomer olefin (TEO), thermoplastic elastomer polyamide (TPAE), and thermoplastic elastomer silicone. The fatty acid includes linoleic acid, oleic acid, lauric acid, and stearic acid.

The "free lubricant powder" in the present invention exists in a simple mixed state without adhering to the iron-based powder or the alloying powder, and is contained in the iron-based powder composition in an amount preferably from 25% to 80% by weight based on the total weight of the lubricants added.

The above iron-based powder composition of the present invention is produced by the process described below. This process is also included in the present invention.

In a typical process for producing the iron-based powder composition for powder metallurgy having higher flowability and higher compactibility of the present invention by fixing an alloying powder by a molten lubricant onto an iron-based powder, the process comprises a first mixing step of mixing, with the iron-based powder and the alloying powder, two or more lubricants selected from the lubricants shown below to obtain a mixture; a melting step of stirring the mixture obtained in the first mixing step with heating up to a temperature higher than the melting point of one of the lubricants to melt the lubricant having a melting point lower than that temperature; a surface treating-fixing step of cooling with stirring the mixture after the melting step, adding a surface treatment agent in a temperature range from 100 to 140° C., and fixing the alloying powder onto the surface of the iron-based powder by the molten lubricant; and a second mixing step of mixing at least one lubricant selected from the group of lubricants shown below with the mixture after the surface treating-fixing step.

Group

Lubricants: fatty acid amides, metal soaps, thermoplastic resins, thermoplastic elastomers, inorganic materials having layer crystal structure, and organic materials having a layer crystal structure.

In the first mixing step in the present invention, preferably one or more lubricants are selected from the aforementioned group of the lubricants, and one of the lubricants is preferably a fatty acid amide. Alteratively in the first mixing step, one or more lubricants may be selected from the metal soaps and the above lubricants, and the aforementioned one of the lubricants may be a metal soap. Only one lubricant may be used in the present invention.

In another typical process for producing the iron-based powder composition having excellent flowability and compactibility of the present invention for powder metallurgy by fixing an alloying powder by a molten lubricant onto an iron-based powder, the process comprises a surface-treating step of coating the iron-based powder and the alloying powder with a surface treatment agent; a first mixing step of mixing, with the iron-based powder and the alloying powder after the surface-treating step, two or more lubricants selected from the lubricants shown above to obtain a mixture; a melting step of stirring the mixture after the first mixing step with heating up to a temperature higher than the melting point of one of the lubricants; a fixing step of cooling with stirring the mixture after the melting step, and fixing the alloying powder onto the surface of the iron-based powder by the molten lubricant; and a secondary mixing step of mixing at least one lubricant selected from the lubricants shown above with the mixture after the fixing step.

In this embodiment also, in the first mixing step, preferably the lubricants are selected from the aforementioned group of the lubricants, and the aforementioned one of the lubricants is preferably a fatty acid amide. Alteratively, in the first mixing step, the one or more lubricants are selected from the metal soaps and the above lubricants, and one of the lubricants is a metal soap. Otherwise, in the first mixing step, two or more lubricants are selected from fatty acids, fatty acid amides, and metal soaps, and the same lubricants are used in the second mixing step. Use of only one lubricant is acceptable also in this embodiment.

In the above production processes, one or more surface treatment agents are employed which are selected from organoalkoxysilanes, organosilazanes, titanate coupling agents, and fluorine-containing silicon silane coupling agents. The above surface treatment agent may be replaced by a mineral oil or silicone fluid. The weight ratio of the lubricant added in the second mixing step is preferably in the range of from 25% to 80% by weight based on the total weight of the lubricants added in the first and second mixing steps.

The process for producing a compact of the present invention is characterized in that any of the aforementioned iron-based mixture is compressed in a die and then the formed compact is ejected therefrom wherein the temperature of the iron-based powder composition in the die is controlled to be higher than the lowest of the melting points of the lubricants contained in the composition but is lower than the highest thereof.

The main constitutional requirements of the present invention are described above. The effects of the surface treatment agent and the lubricants on the flowability and the compactibility are described below in detail, which are the most important points of the present invention.

Generally, flowability of a metal powder is extremely impaired by addition of an organic material like a lubricant as described above. This is caused by high frictional resistance and strong adhesion force between the metal powder and the organic material. This problem may be solved by treating (coating) the surface of the metal powder with a specific organic material to reduce the frictional force and to retard electrostatic adhesion between the different kinds of particles by bringing the surface potential of the metal powder to that of the organic material (excluding the surface treatment agent of the present invention). In other words, the flowability of the powder composition can be improved by synergistic effects of lowered frictional resistance and the lowered contact electrification. Thereby, the flowability can be achieved stably to enable warm compaction in a temperature range from room temperature to about 200° C.

The organic material used therefor in the present invention includes organoalkoxysilanes, organosilazanes, silicone fluids, titanate coupling agents, and fluorine-containing silicon silane coupling agents. Such an organic material, namely a surface treatment agent, has a lubricating function owing to its bulky molecular structure and is effective in a broad temperature range of from room temperature to about 200° C. because of its stability at high temperatures in comparison with fatty acids, mineral oils, and the like. In particular, the organoalkoxysilane, organosilazane, titanate coupling agent or fluorine-containing silicon silane coupling agent undergoes condensation reaction by a functional group thereof with a hydroxy group existing on the surface of a metal powder to form chemical bonding of the organic material onto the surface of the metal powder particle. Thereby, the surface of the metal powder particles is modified, and the effect of modification is remarkable at high temperatures without separation or flowing-away of the organic material.

The organoalkoxysilane has an organic group or groups which may be unsubstituted or substituted by a group of acryl, epoxy, or amino, but unsubstituted one is preferred. The organoalkoxysilane may be a mixture of different ones. However, an epoxy-containing one and an amino-containing one should not be mixed since they react together to cause deterioration. The number of alkoxy group ($C_nH_{2n+1}O$—) in the organoalkoxysilane is preferably less.

The organoalkoxysilane having an unsubstituted organic group includes methyltrimethoxysilane, phenyltrimethoxysilane, and diphenyldimethoxysilane. The one having an acryl-substituted organic group includes γ-methacryloxypropyl-trimethoxysilane. The one having an epoxy-substituted organic group includes γ-glycidoxypropyl-trimethoxysilane. The one having an amino group includes N-β(aminoethyl)-γ-aminopropyl-trimethoxysilane. Of the above organoalkoxysilanes, the fluorine-containing silicon silane coupling agents are useful in which a part of the hydrogen atoms in the organic group are replaced by fluorine. The titanate coupling agent includes isopropyltriisostearoyl titanate.

The organosilazane is preferably an alkylsilazane. A poly-organosilazane having a higher molecular weight may be used.

In place of the above surface treatment agents, silicone fluid, or a mineral oil is useful in the present invention. The silicone fluid is bulky, and reduces frictional resistance between particles by adhesion onto the surface of the metal powder particles to improve flowability of the powder. This lubrication effect is given over a broad temperature range owing to its thermal stability. The silicone fluid useful as the surface treatment agent includes dimethyl silicone fluid, methylphenyl silicone fluid, methylhydrogen silicone fluid, methylpolycyclosiloxanes, alkyl-modified silicone fluid, amino-modified silicone fluid, silicone-polyether copolymers, higher aliphatic acid-modified silicone fluid, epoxy-modified silicone fluid, and fluorine-modified silicone fluid. The mineral oil is useful because it improves flowability of a powder and is thermally stable to give the lubricating effect over a broad temperature range. An alkylbenzene is preferred as the mineral oil, but is not limited thereto in the present invention.

The surface treatment agent is added to the iron-based powder composition in an amount ranging from 0.001 to 1.0 wt % based on treated powder (100 wt %). With the addition of less than 0.001 wt %, the flowability will become lower, whereas with the addition of more than 1.0 wt %, the flowability will become lower.

Next, the lubricant is explained below. The lubricant is incorporated into the powder composition for the following reasons. Firstly, the lubricant serves as a binder for fixing the alloying powder to the iron-based powder to prevent segregation of the alloying powder and generation of dust. Secondly, the lubricant promotes rearrangement and plastic deformation of the powder in the compaction process to increase the green density of the compact owing to lubrication action mainly in a solid state. Thirdly, the lubricant reduces frictional resistance between the die wall and the formed compact at the ejection of the compact from the die to decrease the ejection force.

For achieving such effects, the powder composition in the present invention is prepared by mixing the alloying powder and the lubricant into the iron-based powder, heating the composition at a temperature higher than the melting. point of at least one of the lubricants, and cooling it. When only one kind of lubricant is used, the lubricant is melted. When two or more kinds of lubricants are used, one lubricant having a melting point of lower than the heating temperature is melted. The melted lubricant forms liquid bridges between the iron-based powder and the alloying powder or the unmelted lubricant near the iron-based powder particles to allow the alloying powder and/or the unmelted lubricant to adhere to the surface of the iron-based powder. By solidification of the melted lubricant, the alloying powder is fixed to the iron-based powder. For example, with two lubricants having respectively a melting point of 100° C. and 146° C., the composition may be heated to 160° C. to melt the two lubricants, or may be heated to 130° C. to melt one lubricant with the other lubricant kept unmelted.

If the heating temperature for melting the lubricant exceed 250° C., oxidation of the iron-based powder proceed to lower its compactibility. Therefore, at least one lubricant has preferably a melting point lower than 250° C. to conduct heating at a temperature lower than 250° C.

In compaction of the iron-based powder composition, the lubricant as a binder promotes arrangement and plastic deformation of the powder. Therefore, the lubricant is desirably dispersed uniformly on the surface of the iron-based powder. On the other hand, ejection force on removal of the compact from the die is reduced by the lubricant existing in a solid state on the surface of the compact, the lubricant liberated from the iron-based powder surface, and the lubricant sticking onto the iron-based powder surface in an unmelted state during the preparation of the composition. The latter is more important.

For achieving both of the above effects simultaneously, the amount of the free lubricant existing in the interspace of the iron-based powder particles is adjusted to be in the range from 25% to 80% by weight based on the total amount of the lubricant. With the free lubricant of less than 25% by weight, the ejection force for removing the compact is not decreased, and scratches can be formed on the surface of the compact, whereas with the free lubricant of more than 80% by weight, the fixation of the alloying powder onto the iron-based powder is weak, causing segregation of the alloying powder to result in variation of the quality of the final sintered product. Incidentally, for increasing the free lubricant in the powder composition, the lubricant is supplementally added in the second mixing step.

The lubricant is preferably a fatty acid amides and/or a metal soaps, and additionally at least one material selected from inorganic compounds having a layer crystal structure, organic compounds having a layer crystal structure, thermoplastic resins, and thermoplastic elastomers is added preferably thereto. More preferably, a fatty acid is added into a fatty acid amides and/or a metal soaps.

The use of a material having a layer crystal structure reduces the ejection force required after the compaction, improving the compactibility. This is considered to be due to the fact that the material can readily be cleaved along the crystal plane by shearing force in the compaction to reduce the frictional resistance between the particles in the compact and facilitate slippage between the compact and the die. The inorganic material having a layer crystal structure includes graphite, $MoS_2$, and carbon fluorides. A smaller particle size is effective for reduction of the ejection force.

The organic compound having a layer crystal structure includes melamine-cyanuric acid adduct (MCA), and β-alkyl-N-alkylaspartic acid.

Further addition of a thermoplastic resin or a thermoplastic elastomer to the iron-based powder and the alloying powder reduces the ejection force in compaction, especially in warm compaction. The thermoplastic resin has lower yield stress at higher temperature, and is deformed readily by lower pressure. In warm compaction of a metal powder containing particulate thermoplastic resin by heating, the thermoplastic resin particles undergoes plastic deformation readily among the metal particles or between the metal particles and the die wall to reduce the frictional resistance between the metal faces.

The thermoplastic elastomer is a material having a mixed phase texture having a thermoplastic resin (rigid phase) and a rubber-structured polymer (flexible phase). With elevation of the temperature, the yield stress of the rigid phase of the thermoplastic resin decreases to cause deformation readily at a lower stress. Therefore, the particulate thermoplastic elastomer contained in the metal particles gives the same effects as the aforementioned thermoplastic resin in warm compaction. The suitable particulate thermoplastic resin includes polystyrene, nylon, polyethylene, and fluoroplastics. The thermoplastic elastomer has preferably a rigid phase of resins including styrenic resins, olefinic resins, amide resins, and silicone resins. Of these, styrene-acrylic copolymers, styrene-butadiene copolymers are preferred. The above thermoplastic resin or the thermoplastic elastomer has a particle size of not larger than 30 $\mu$m, preferably in the range of from 5 to 20 $\mu$m. With the particle size of larger than 30 $\mu$m, the resin or elastomer does not dispersed sufficiently among the metal particles, not giving the desired lubrication effects.

Alternatively, the lubricant may be a fatty acid amide and/or a metal soap, and if desired further, a fatty acid may be incorporated. However, the fatty acid, which has generally a low melting point, forms liquid bridges by melting between the iron-based powder particles when exposed to a temperature higher than 150° C., tending to lower the flowability of the powder composition. Therefore, it should be used at a temperature not higher than about 150° C.

The last description on the lubricant is shown below. The lubricant is incorporated into the iron-based powder composition in a total amount ranging from 0.1 to 2.0 wt % based on the iron-based powder (100 wt %). At the lubricant content of less than 0.1 wt %, the compactibility of the powder composition will be lower, whereas at the lubricant content of more than 2.0 wt %, the green density of the compact produced from the powder composition will be lower to give lower strength of the compact. In the present invention, one or more lubricants selected from metal soaps and fatty acid amides are preferably incorporated as a part or the entire of the lubricant. The metal soap includes zinc stearate, lithium stearate, lithium hydroxystearate, calcium stearate, and calcium laurate. The metal soap is preferably incorporated at a content ranging from 0.01 to 1.0 wt % based on the iron-based powder composition (100 wt %). At the metal soap content of higher than 0.01 wt %, the flowability of the composition is improved, whereas at the content of higher than 1.0 wt %, the strength of the compact produced from the composition is lower. The aforementioned fatty acid amide is selected from fatty acid monoamides and fatty acid bisamides. The fatty acid amide is preferably incorporated into the iron-based powder composition at a content ranging from 0.01 to 1.0 wt % based on the iron-based powder composition (100 wt %). At the fatty acid amide content of higher than 0.01 wt %, the compactibility of the powder composition is improved, whereas at the content thereof higher than 1.0 wt %, the density of the compact is lower.

In the present invention, the surface treatment agent employed for the purpose of improving flowability also serves to decrease the ejection force of the compact in the compaction of the powder composition as a secondary effect. The mechanism thereof is described below.

In production of a compact from a powdery matter by warm compaction, since the density of the compact is high, the metal powder particles on the compact surface tend to adhere to a die wall by compaction pressure, thereby a large ejection force being required for removal of the compact from the die, and the compact surface being scratched. By preliminarily coating the metal powder surface with a surface treatment agent of the present invention, a coating film is formed between the die wall and the metal powder on the compact surface. Thereby the ejection force is reduced, and the scratching of the compact and other problems are solved.

The present invention also provides a process for producing a high-density compact from an iron-based powder composition by utilizing the above secondary effects.

The process for producing a compact uses the aforementioned iron-based powder composition of the present invention. In the process, the composition is filled in a die, and is compacted with heating to a prescribed temperature to obtain a high-density compact.

The heating temperature thereof is selected in consideration of melting points of two or more lubricants added in the first mixing step. Specifically, the temperature is set between the lowest melting point and the highest melting point of the lubricants. When heated to a temperature higher than the lowest melting point of the mixed lubricants, the melted lubricant penetrates uniformly into the interspace of the powder by capillarity, thereby arrangement and plastic deformation of the powder is effectively promoted in press compaction to increase the density of the compact. In this step, the melted lubricant serves as a binder for fixing an alloying powder to the surface of the iron-based powder. The lubricant of the higher melting point in an unmelted state is dispersed over the surface of the iron-based powder or exists free state in the powder composition during preparation of the powder composition.

The lubricant existing in a free state or in a unmelted solid state in the powder composition disperses in the gap between the die and the compact to reduce the ejection force for removal of the high-density compact formed by compaction from the die.

When the compaction is conducted at a temperature lower than the melting points of all of the lubricants, no lubricant is melted, thereby arrangement and plastic deformation of the powder not being caused; the lubricant in the powder particle interspace does not emerge on the surface of the compact, causing a lower density of the produced compact. On the other hand, when the compaction is conducted at a temperature higher than the melting points of all of the lubricants, no lubricant is in a solid state, thereby the ejection force for removal of the compact from the die being increased and the compact surface being scratched; and during the rise of the density of the compact, the melted lubricants in the interspace of the powder particles is driven out to the surface of the formed compact to form coarse voids to lower the mechanical properties of the compact. Accordingly, adjustment of the amount of the free lubricant or unmelted lubricant in a solid state and the amount of the melted lubricant is especially important in the present invention.

Incidentally, the inorganic compound having a layer crystal structure, the organic compound having a layer structure, and the thermoplastic elastomer as the lubricants have no melting point. For such kinds of lubricants, a thermal decomposition temperature or a sublimation-beginning temperature is taken in place of the melting point in the present invention.

BEST MODE FOR PRACTICING THE INVENTION

The best mode of the present invention is described below specifically by reference to examples.

(Embodiment 1)

A solution of a surface treatment agent was prepared by dissolving an organoalkoxysilane, an organosilazane, a titanate coupling agent, or a fluorine-containing silicon silane coupling agent in ethanol, or silicone fluid, or a mineral oil in xylene. The solution was sprayed in a proper amount on a pure iron powder for powder metallurgy having an average particle size of 78 μm, natural graphite for alloying powder having an average particle size of 23 μm or less, or a copper powder having an average particle size of 25 μm or less. Each of the obtained powders was blended by high-speed mixer at a mixing blade speed of 1000 rpm for one minute. Then the solvent was removed by a vacuum dryer. The powder sprayed with the silane, the silazane, or the coupling agent was further heated at about 100° C. for one hour. The above treatment is referred to as Surface Treatment Step A1.

Table 1 shows the surface treatment agents used in Surface Treatment Step A1, and the added amounts thereof. In Table 1, the symbols for the surface treatment agents are as shown in Table 16.

An iron powder for powder metallurgy having an average particle diameter of 78 μm, a natural graphite powder having a average particle diameter of 23 μm or less, and a copper powder having an average diameter of 25 μm or less, each having been subjected or not subjected to Surface Treatment Step A1 respectively were mixed. Thereto, were added 0.2 wt % of stearamide (mp: 100° C.), and 0.2 wt % of ethylenebis(stearamide) (mp: 146–147° C.) as the lubricant. The mixture was heated to 110° C. with stirring (First Mixing Step and Melting Step). Then the resulting mixture was cooled to 85° C. or lower with stirring (Fixing Step).

To the resulting powder composition, were added 0.2 wt % of stearamide (mp: 100° C.), and 0.15 wt % of zinc stearate (mp; 116° C.). The mixture was blended uniformly, and was discharged from the mixer (Second Mixing Step). The obtained powder compositions were referred to as Examples 1–11.

For comparison, a powder composition was prepared by treating an iron powder for powder metallurgy having an average particle diameter of 78 μm, a natural graphite powder having a average particle diameter of 23 μm or less, and a copper powder having an average diameter of 25 μm or less, each not having been subjected to Surface Treatment Step A1 respectively in the same manner as above (Comparative Example 1).

Subsequently, 100 g of each of the powder compositions prepared above was allowed to pass through a vertical discharging orifice of 5 mm diameter, and the time of complete discharge (flow rate) was measured as the index of the powder flowability. Table 1 shows the results.

Obviously from comparison of Comparatiave Example 1 with Examples 1–11, the flowability of the powder composition having been subjected to the surface treatment step of the present invention was greatly improved in comparison with that of Comparative Example 1.

(Embodiment 2)

A pure iron powder for powder metallurgy having an average particle diameter of 78 μm, a natural graphite powder having a average particle diameter of 23 μm or less, and a copper powder having an average diameter of 25 μm or less were mixed. To the mixture, was sprayed the solution of an organoalkoxysilane, an organosilazane, a titanate coupling agent, a fluorine-containing silicon silane coupling agent, silicone fluid, or a mineral oil in a proper amount as the surface treatment agent (hereinafter referred to as Surface Treating Step B1).

Each of the powder compositions having been coated with the different surface treatment agent was blended respectively by a high-speed mixer at a stirring blade rate of 1000 rpm for one minute (First Mixing Step). Thereto, 0.1 wt % of oleic acid (mp: 14° C.), and 0.3 wt % of zinc stearate (mp: 116° C.) was added as the lubricant, and the mixture was heated to 110° C. with stirring (Melting Step). Then the mixture was cooled to 85° C. or lower (Fixing Step).

Table 2 shows the surface treatment agents used in Surface Treating Step B1, and the added amounts thereof. In Table 2, the surface treatment agents are represented by the symbols shown in Table 16.

To each of the resulting powder compositions, was added 0.4 wt % of zinc stearate (mp; 116° C.). The mixture was blended uniformly, and was discharged from the mixer (Second Mixing Step). The obtained powder compositions were referred to as Examples 12–17.

For comparison, a powder composition was prepared by treating an iron powder for powder metallurgy having an average particle diameter of 78 μm, a natural graphite powder having an average particle diameter of 23 μm or less, and a copper powder having an average diameter of 25 μm or less in the same manner as above except that Surface Treatment Step B1 was not conducted (Comparative Example 2).

Subsequently, 100 g of each of the powder compositions prepared above was tested for flowability in the same manner as in Embodiment 1. Table 2 shows the experimental results.

Obviously from comparison of Comparative Example 2 with Examples 12–17, the flowability of the powder composition having been subjected to the surface treatment step of the present invention was greatly improved in comparison with that of Comparative Example.

(Embodiment 3)

A pure iron powder for powder metallurgy having an average particle diameter of 78 μm, a natural graphite powder having a average particle diameter of 23 μm or less, and a copper powder having an average diameter of 25 μm or less were mixed. Thereto, 0.2 wt % of stearamide (mp: 100° C.), and 0.2 wt % of ethylenebis(stearamide) (mp: 146–147° C.) were added as the lubricant. The mixture was heated to 110° C. with stirring (First Mixing/Melting Step). To the resulting mixture, was sprayed the solution of an organoalkoxysilane, an organosilazane, a titanate coupling agent, a fluorine-containing silicon silane coupling agent, silicone fluid, or a mineral oil in a proper amount as the surface treatment agent. Each of the powder compositions having been coated with the different surface treatment agent was blended respectively by a high-speed mixer at a stirring blade rotation rate of 1000 rpm for one minute. Then the mixture was cooled to 85° C. or lower (Surface-Treating/Fixing Step C1).

Table 3 shows the surface treatment agents used in Surface Treating/Fixing Step C1, and the added amounts thereof. In Table 3, the surface treatment agents are represented by the symbols shown in Table 16.

To the resulting powder mixture, were added 0.2 wt % of stearamide (mp: 100° C.), and 0.15 wt % of zinc stearate (mp: 116° C.) as the lubricant, and the mixture was blended uniformly, and was discharged from the mixer (Second Mixing Step). The obtained powder compositions were referred to as Examples 18–22.

For comparison, a powder composition was prepared by treating an iron powder for powder metallurgy having an average particle diameter of 78 μm, a natural graphite powder having an average particle diameter of 23 μm or less, and a copper powder having an average diameter of 25 μm or less in the same manner as above except that Surface-Treating/Fixing Step C1 was not conducted (Comparative Example 3).

Each of the powder compositions prepared above was tested for flowability in the same manner as in Embodiment 1. Table 3 shows the experimental results.

Obviously from comparison of Comparative Example 3 with Examples 18–22, the flowability of the powder composition having been subjected to the surface treatment step of the present invention was greatly improved in comparison with that of Comparative Example 3.

(Embodiment 4)

A solution of a surface treatment agent was prepared by dissolving an organoalkoxysilane, an organosilazane, a titanate coupling agent, or a fluorine-containing silicon silane coupling agent in ethanol, or silicone fluid, or a mineral oil in xylene. The solution was sprayed in a proper amount on an alloy steel powder (completely alloyed steel powder having component composition of Fe—2 wt % Cr—0.7 wt % Mn—0.3 wt % Mo for powder metallurgy having an average particle size of about 80 μm, or natural graphite having an average particle diameter of 23 μm or less.

Each of the obtained powders was mixed by a high-speed mixer at a mixing blade rotation speed of 1000 rpm for one minute. Then the solvent was removed by a vacuum dryer. The powder sprayed with the silane, the silazane, or the coupling agent was further heated at about 100° C. for one hour. The above treatment is referred to as Surface Treatment Step A2.

Table 4 shows the surface treatment agents used in Surface Treatment Step A2, and the added amounts thereof. In Table 4, the surface treatment agents are represented by the symbols shown in Table 16.

The alloyed steel powder for powder metallurgy having an average particle diameter of about 80 μm, and a natural graphite powder having a average particle diameter of 23 μm or less, each having been subjected or not subjected to Surface Treating Step A2 respectively were mixed. Thereto, were added 0.1 wt % of stearamide (mp: 100° C.), 0.2 wt % of ethylenebis(stearamide) (mp: 146–147° C.), and 0.1 wt % of lithium stearate (mp: 230° C.) as the lubricant, and the mixture was stirred (First Mixing Step). Then the mixture was heated to 160° C. with stirring (Melting Step). Then the resulting mixture was cooled to 85° C. or lower (Fixing Step).

To the resulting powder composition, was added 0.4 wt % of lithium stearate (mp: 230° C.) as the lubricant. The mixture was blended uniformly, and was discharged from the mixer (Second Mixing Step). The obtained powder compositions were referred to as Examples 23–27.

For comparison, a powder composition was prepared by treating the alloy steel powder (completely alloyed steel powder having component composition of Fe—2.0 wt % Cr—0.7 wt % Mn—0.3 wt % Mo) for powder metallurgy having an average particle diameter of about 80 μm, and natural graphite having an average particle diameter of 23 μm or less, each not having been subjected to Surface Treatment Step A2 respectively (Comparative Example 4).

Subsequently, 100 g of each of the powder compositions prepared above was heated to a prescribed temperature ranging from 20 to 140° C. and was allowed to pass through an orifice of 5 mm diameter to measure the flowability in the same manner as in Embodiment 1. Table 4 shows the experimental results.

Obviously from comparison of Comparative Example 4 with Examples 23–27, the flowability of the powder composition having been subjected to the surface treatment step of the present invention was greatly improved in comparison with that of Comparative Example 1.

(Embodiment 5)

A partially diffusion-alloyed steel powder (having component composition of Fe—4.0 wt % Ni—1.5 wt % Cu—0.5 wt % Mo) for powder metallurgy having an average particle size of about 80 μm, and natural graphite having an average particle diameter of 23 μm or less were mixed. To the mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount (Surface Treating Step B2).

Each of the powders coated with the surface treatment agent was blended by a high-speed mixer at a mixing blade rotation speed of 1000 rpm for one minute (First Mixing Step). To the resulting mixture, were added 0.2 wt % of stearamide (mp: 100° C.), and 0.2 wt % of ethylenebis (stearamide) (mp: 146–147° C.) as the lubricant. Then the mixture was heated to 160° C. with stirring (Melting Step). The resulting mixture was cooled to 85° C. or lower (Fixing Step).

Table 5 shows the surface treatment agents used in Surface Treatment Step B2, and the added amounts thereof. In Table 5, the surface treatment agents are represented by the symbols shown in Table 16.

To each of the powder mixtures obtained above, was added 0.4 wt % of lithium hydroxystearate (mp: 216° C.) as the lubricant, and the mixture was mixed uniformly by stirring, and discharged from the mixer (Second Mixing Step). The powder compositions are referred to as Examples 28–31.

For comparison, a powder composition was prepared by treating the partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm or less in the same manner as above except that Surface Treatment Step B2 was not conducted (Comparative Example 5).

Each of the powder compositions prepared above was tested for flowability in the same manner as in Embodiment 1. Table 5 shows the experimental results.

Obviously from comparison of Comparative Example 5 with Examples 28–31, the flowability of the powder composition having been subjected to the surface treatment step of the present invention was greatly improved in comparison with that of Comparative Example 5.

(Embodiment 6)

A partially diffusion-alloyed steel powder (having a component composition of Fe—2.0 wt % Cu) for powder metallurgy having an average particle size of about 80 μm, and natural graphite having an average particle diameter of 23 μm or less were mixed (First Mixing Step). Thereto, were added 0.2 wt % of stearamide (mp: 100° C.), and 0.2 wt % of ethylenebis(stearamide) (mp: 146–147° C.) as the lubricant. Then the mixture was heated to 160° C. with stirring (Melting Step). The resulting mixture was cooled to about 110° C. To the powder mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount. Each of the powder mixtures coated with the surface treatment agent was blended by a high-speed mixer at a mixing blade rotation speed of 1000 rpm for one minute, and was cooled to 85° C. or lower (Surface-Treating/Fixing Step C2).

Table 6 shows the surface treatment agents used in Surface-Treating/Fixing Step C2, and the added amounts thereof. In Table 6, the surface treatment agents are represented by the symbols shown in Table 16.

To each of the powder mixtures obtained above, was added 0.4 wt % of lithium hydroxystearate (mp: 216° C.) as the lubricant , and the mixture was blended uniformly by stirring, and was discharged from the mixer (Second Mixing Step). The powder compositions are referred to as Examples 32–34.

Each of the powder compositions prepared above was tested for flowability in the same manner as in Embodiment 1. Table 6 shows the experimental results.

Obviously from comparison of Comparative Example 5 with Examples 32–34, the flowability of the powder composition having been subjected to the surface treating/fixing step of the present invention was greatly improved in comparison with that of Comparative Example 5.

(Embodiment 7)

A solution of a surface treatment agent was prepared by dissolving an organoalkoxysilane, an organosilazane, a titanate coupling agent or a fluorine-containing silicon silane coupling agent in ethanol, or silicone fluid, or a mineral oil in xylene. The solution was sprayed in a proper amount on a partially diffusion-alloyed steel powder (having component composition of Fe—4.0 wt % Ni—1.5 wt % Cu—0.5 wt % Mo) for powder metallurgy having an average particle diameter of about 80 μm, or natural graphite having an average particle diameter of 23 μm or less. Each of the obtained powders was blended by a high-speed mixer at a mixing blade rotation speed of 1000 rpm for one minute. Then the solvent was removed by a vacuum dryer. The powder sprayed with the silane, the silazane, or the coupling agent was heated at about 100° C. for one hour (Surface Treating Step A2).

Tables 7 and 8 show the surface treatment agents used in Surface Treatment Step A2, and the added amounts thereof. In Tables 7 and 8, the surface treatment agents are represented by the symbols shown in Table 16.

The alloyed steel powder for powder metallurgy having an average particle diameter of about 80 μm, and a natural graphite powder having a average particle diameter of 23 μm or less, each having been subjected or not subjected to Surface Treating Step A2 respectively were mixed. Thereto, were added 0.1 wt % of stearamide (mp: 100° C.), 0.2 wt % of ethylenebis(stearamide) (mp: 146–147° C.), and 0.1 wt % of one of a thermoplastic resin, a thermoplastic elastomer, and a material having a layer crystal structure as the lubricant, and the mixture was blended (First Mixing Step). The mixture was heated to 160° C. (Melting Step). Then the resulting mixture was cooled to 85° C. or lower (Fixing Step) to obtain a powder mixture.

Tables 7 and 8 show the lubricants used (thermoplastic resin, thermoplastic elastomer, or material having layer crystal structure), and the added amounts thereof. In Tables 7 and 8, the lubricants are represented by the symbols shown in Table 17.

For comparison, a powder mixture was prepared by mixing the partially diffusion-alloyed steel powder (having component composition of Fe—4.0 wt % Ni—1.5 wt % Cu—0.5 wt % Mo) for powder metallurgy having an average particle diameter of about 80 μm, and the natural graphite having an average particle diameter of 23 μm or less, and treating the mixture as above without adding the lubricant.

To the resulting powder composition, was added at least one lubricant of lithium stearate (mp: 230° C.), lithium hydroxystearate, (mp: 216° C.), and calcium laurate (mp: 170° C.) in a total amount of 0.2 wt %. The mixture was blended uniformly by stirring, and was discharged from the mixer (Second Mixing Step). The obtained powder compositions were referred to as Examples 35–39, and Comparative Example 6.

The flowability of the obtained powder composition was measured in the same manner as in Embodiment 1.

Besides the flowability measurement, the powder composition discharged from the mixer was compacted into a tablet of 11 mm diameter in a die by heating to 150° C. at a compaction pressure of 7 ton/cm$^2$, and the ejection force and the density of the compact (green density in Tables) were measured. Tables 7 and 8 show the experimental results.

Obviously from comparison of Comparative Example 6 with Examples 35–39, the flowability of the powder composition was improved markedly by the surface treatment of the present invention at the measured temperatures. The powder composition containing a thermoplastic resin, a thermoplastic elastomer, or a material having a layer crystal structure and having been treated with a surface treatment agent of the present invention was improved in compactibility, giving a compact with a higher green density at a lower compact ejection force.

(Embodiment 8)

A partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm or less were mixed. To the mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount (Surface Treating Step B2).

Each of the powders coated with the surface treatment agent was blended by a high-speed mixer at a mixing blade rotation speed of 1000 rpm for one minute. To the resulting mixture, were added 0.2 wt % of stearamide (mp: 100° C.), 0.2 wt % of ethylenebis(stearamide) (mp: 146–147° C.), and 0.1 wt % of one of a thermoplastic resin, a thermoplastic elastomer, and a material having a layer crystal structure as the lubricant, and the mixture was stirred (First Mixing Step). Then the mixture was heated to 160° C. with stirring (Melting Step). The resulting mixture was cooled to 85° C. or lower (Fixing Step).

Table 9 shows the surface treatment agents used in Surface Treatment Step B2, and the lubricants used in First Mixing Step (thermoplastic resin, thermoplastic elastomer, and material having a layer crystal structure), and the ; added amounts thereof. In Table 9, the surface treatment agents are represented by the symbols shown in Table 16, and the lubricants are represented by the symbols shown in Table 17.

To the resulting powder mixture, was added at least one of lithium stearate (mp: 230° C.), lithium hydroxystearate, (mp: 216° C.), and calcium laurate (mp: 170° C.) in a total amount of 0.2 wt % as the lubricant. The mixture was blended uniformly, and was discharged from the mixer (Second Mixing Step). The obtained powder compositions were referred to as Examples 40–43.

The flowability of the obtained powder composition was measured in the same manner as in Embodiment 1. Besides the flowability measurement, the powder composition discharged from the mixer was compacted into a tablet, and the ejection force and the density of the compacted powder were measured in the same manner as in Embodiment 7. Table 9 shows the experimental results.

Obviously from comparison of Comparative Example 6 with Examples 40–43 in Table 9, the flowability of the powder composition was improved markedly by the surface treatment of the present invention at the measured temperatures. The powder composition containing a thermoplastic resin, a thermoplastic elastomer, or a material having a layer crystal structure and having been treated with a surface treatment agent of the present invention was improved in compactibility, giving a compact with a higher green density at a lower compact ejection force.

(Embodiment 9)

A partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm or less were mixed. Thereto, were added 0.2 wt % of stearamide (mp: 100° C.), 0.2 wt % of ethylenebis(stearamide) (mp: 146–147° C.), and 0.1 wt % of one of a thermoplastic resin, a thermoplastic elastomer, and a material having a layer crystal structure as the lubricant, and the mixture was blended. Then the mixture was heated to 160° C. with stirring (First Mixing Step, Melting Step). The resulting mixture was cooled to about 110° C.

To the powder mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount. Each of the powder mixtures was blended by a high-speed mixer at a mixing blade rotation speed of 1000 rpm for one minute, and was cooled to 85° C. or lower (Surface-Treating/Fixing Step C2).

Tables 10 and 11 show the surface treatment agents used in Surface-Treating/Fixing Step C2, and the lubricants used in First Mixing Step (thermoplastic resin, thermoplastic elastomer, and material having a layer crystal structure), and the added amounts thereof. In Tables 10 and 11, the surface treatment agents are represented by the symbols shown in Table 16, and the lubricants are represented by the symbol shown in Table 17.

To each of the powder mixtures obtained above, was added 0.4 wt % of lithium hydroxystearate (mp: 216° C.) as the lubricant, and the mixture was blended uniformly by stirring, and was discharged from the mixer (Second Mixing Step). The powder compositions are referred to as Examples 44–48. The flowability of the obtained powder composition was measured in the same manner as in Embodiment 1. Besides the flowability measurement, the powder composition discharged from the mixer was compacted with dies into tablets of 11 mm diameter by heating respectively to temperatures of 130° C., 150° C., 170° C., 190° C. and 210° C. at a compaction pressure of 7 ton/cm$^2$. The ejection force and the density of the compacted powder were measured in the same manner as above. Table 10 and 11 show the experimental results.

Obviously from comparison of Comparative Example 6 with Examples 44–48 in Table 10 and 11, the flowability of the powder composition was improved markedly by the surface treatment of the present invention at the measured temperatures. The powder composition containing a thermoplastic resin, a thermoplastic elastomer, or a material having a layer crystal structure and having been treated with a surface treatment agent of the present invention gave compacts with a higher green density at a lower compact ejection force over a broad compaction temperature range from 130° C. to 210° C. as shown by Example 44. The compact produced at the compaction temperature of 70° C. or 90° C. had a slightly low green density, whereas the compacts produced at the compaction temperature of 220° C. or 240° C. were inferior in compactibility and required greater ejection force, in comparison with the compact produced at the compaction temperature of 130–210° C.

(Embodiment 10)

A solution of a surface treatment agent was prepared by dissolving an organoalkoxysilane, an organosilazane, a titanate coupling agent, or a fluorine-containing silicon silane coupling agent in ethanol, or silicone fluid, or a mineral oil in xylene. The solution was sprayed in a proper amount on a partially diffusion-alloyed steel powder (having component composition of Fe—4.0 wt % Ni—1.5 wt % Cu—0.5 wt % Mo) for powder metallurgy having an average particle diameter of about 80 μm, or natural graphite having an average particle diameter of 23 μm or less. Each of the obtained powders was mixed by a high-speed mixer at a mixing blade rotation speed of 1000 rpm for one minute. Then the solvent was removed by a vacuum dryer. The mixture containing the powder sprayed with the silane, the silazane, or the coupling agent was heated at about 100° C. for one hour (Surface Treating Step A2).

Table 12 shows the surface treatment agents used in Surface Treating Step A2, and the added amounts thereof. In Table 12, the surface treatment agents are represented by the symbols shown in Table 16.

The partially alloyed steel powder for powder metallurgy having an average particle diameter of about 80 μm, and a natural graphite powder having a average particle diameter of 23 μm or less, each having been subjected or not subjected to Surface Treating Step A2 respectively were mixed. Thereto, were added 0.1 wt % of stearamide (mp: 100° C.), 0.2 wt % of ethylenebis(stearamide) (mp: 146–147° C.), and 0.1 wt % of one of a thermoplastic resin, a thermoplastic elastomer, and a material having a layer crystal structure as the lubricant, and the mixture was blended (First Mixing Step). The mixture was heated to 160° C. with stirring (Melting Step). Then the resulting mixture was cooled with stirring to 85° C. or lower (Fixing Step).

Table 12 shows the lubricants used (thermoplastic resin, thermoplastic elastomer, or material having layer crystal structure), and the added amounts thereof. In Table 12, the lubricants are represented by the symbols shown in Table 17.

To the resulting powder mixture, was added at least one of lithium stearate (mp: 230° C.), lithium hydroxystearate (mp: 216° C.), and calcium laurate (mp: 170° C.) in a total amount of 0.2 wt % as the lubricant. The mixture was blended uniformly, and was discharged from the mixer (Second Mixing Step). The obtained powder compositions were referred to as Examples 49–52. The flowability of the obtained powder composition was measured in the same manner as in Embodiment 1. Besides the flowability measurement, the powder composition discharged from the mixer was compacted into a tablet of 11 mm diameter in a die by heating to 150° C. at a compaction pressure of 7 ton/cm$^2$, and the ejection force and the green density of the compact were measured. Tables 12 shows the experimental results.

Obviously from comparison of Comparative Example 6 with Examples 49–52 in Table 12, the flowability of the powder composition was improved markedly by the surface treatment of the present invention at the measured temperatures. The powder composition containing a thermoplastic resin, a thermoplastic elastomer, or a material having a layer crystal structure and having been treated with a surface treatment agent of the present invention had a higher green density and was ejected at a lower compact ejection force.

(Embodiment 11)

A partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm or less were mixed. To the mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount (Surface Treating Step B2).

Each of the powder mixtures was blended by a high-speed mixer at a mixing blade rotation speed of 1000 rpm for one minute. To the resulting mixture, were added 0.1 wt % of calcium stearate (mp: 148–155° C.), and 0.3 wt % of lithium stearate (mp: 230° C.) as the lubricant, and the mixture was blended (First Mixing Step). Then the mixture was heated to 160° C. with stirring (Melting Step). The resulting mixture was cooled to 85° C. or lower (Fixing Step).

Table 13 shows the surface treatment agents used in Surface Treatment Step B2, and the added amounts thereof. In Table 13, the surface treatment agents are represented by the symbols shown in Table 16.

To the resulting powder mixture, were added 0.1 wt % of lithium stearate (mp: 230° C.), and additionally at least one of a thermoplastic resin, a thermoplastic elastomer, and a material having a layer crystal structure in a total amount of 0.2 wt % as the lubricant. The mixture was blended uniformly, and was discharged from the mixer (Second Mixing Step). The obtained powder compositions were referred to as Examples 53–56. Table 13 shows the lubricants added and the amount thereof. In Table 13, the lubricants are represented by the symbols shown in Table 17.

The flowability of the obtained powder composition was measured in the same manner as in Embodiment 1. Besides the flowability measurement, the powder composition discharged from the mixer was compacted into a tablet under the same conditions in Embodiment 10. Table 13 shows the compact ejection forces, the green densities, and the flowabilities of the powder compositions.

Obviously from comparison of Comparative Example 6 with Examples 53–56 in Table 13, the flowability of the powder composition was improved markedly by the surface treatment of the present invention at the measured temperatures. The powder composition containing a thermoplastic resin, a thermoplastic elastomer, or a material having a layer crystal structure and having been treated with a surface treatment agent of the present invention was improved in compactibility, giving a compact with a higher compact density at a lower compact ejection force.

(Embodiment 12)

A partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm or less were mixed, and thereto, were added 0.2 wt % of stearamide (mp: 100° C.), and 0.2 wt % of ethylenebis(stearamide) (mp: 146–147° C.) as the lubricant, and the mixture was blended (First Mixing Step). Then the mixture was heated to 160° C. with stirring (Melting Step). The resulting mixture was cooled to about 110° C. To the powder mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount. Each of the powder mixtures coated with the surface treatment agent was blended by a high-speed mixer at a mixing blade rotation speed of 1000 rpm for one minute, and was cooled to 85° C. or lower (Surface-Treating/Fixing Step C2).

Table 14 shows the surface treatment agents used in Surface-Treating/Fixing Step C2, and the added amounts thereof. In Table 14, the surface treatment agents are represented by the symbols shown in Table 16.

To the resulting powder mixture, were added 0.1 wt % of lithium stearate (mp: 230° C.), and additionally at least one of a thermoplastic resin, a thermoplastic elastomer, and a material having a layer crystal structure in a total amount of 0.2 wt % as the lubricant. The mixture was blended uniformly, and was discharged from the mixer (Second Mixing Step). The obtained powder compositions were referred to as Examples 57–59. Table 14 shows the lubricants added and the amount thereof. In Table 14, the lubricants are represented by the symbols shown in Table 17.

The flowability of the obtained powder composition was measured in the same manner as in Embodiment 1. Besides the flowability measurement, the powder composition discharged from the mixer was compacted into a tablet under the same conditions in Embodiment 11. The compact ejection force, and the green density of the compact were measured. Table 14 shows the results.

Obviously from comparison of Comparative Example 6 with Examples 57–59 in Table 14, the flowability of the powder composition was improved markedly by the surface treatment of the present invention at the measured temperatures. The powder composition having been surface-treated according to the present invention was improved in compactibility, giving a compact with a higher green density at a lower compact ejection force.

(Embodiment 13)

A partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm or less were mixed, and thereto, were added 0.2 wt % of stearamide (mp: 100° C.), and 0.2 wt % of ethylenebis(stearamide) (mp: 146–147° C.) as the lubricant, and the mixture was blended (First Mixing Step). Then the mixture was heated to 160° C. with stirring (Melting Step). The resulting mixture was cooled to about 110° C. To the powder mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount. Each of the powder mixtures coated with the surface treatment agent was blended by a high-speed mixer at a mixing blade rotation speed of 1000 rpm for one minute, and was cooled to 85° C. or lower (Surface-Treating/Fixing Step C2).

Table 15 shows the surface treatment agents used in Surface-Treating/Fixing Step C2, and the added amounts thereof. In Table 15, the surface treatment agents are represented by the symbols shown in Table 16.

To the resulting powder mixture, were added 0.1 wt % of lithium stearate (mp: 230° C.), and additionally at least one of a thermoplastic resin, a thermoplastic elastomer, and a material having a layer crystal structure in a total amount of 0.2 wt % as the lubricant. The mixture was blended uniformly, and was discharged from the mixer (Second Mixing Step). The obtained powder compositions were referred to as Examples 60–63. Table 15 shows the lubricants added and the amount thereof. In Table 15, the lubricants are represented by the symbols shown in Table 17.

The flowability of the obtained powder composition was measured in the same manner as in Embodiment 1. Besides the flowability measurement, the powder composition discharged from the mixer was compacted into a tablet under the same conditions in Embodiment 12. The compact ejection force, and the green density of the compact were measured. Table 15 shows the results.

Obviously from comparison of Comparative Example 6 with Examples 60–63 in Table 15, the flowability of the powder composition was improved markedly by the surface treatment of the present invention at the measured temperatures. The powder composition having been subjected to the surface treatment of the present invention gave a compact with a higher green density at a lower compact ejection force.

(Embodiment 14)

An alloyed steel powder was surface-treated in the same manner as in Embodiment 4 according to Surface Treating Step A2 except that the iron-based powder shown in Tables 18–21 was used. Tables 18–21 shows the surface treatment agent used in Surface Treating Step A2, and the amount thereof. In Tables 18–21, the surface treatment agents are represented by the symbols shown in Table 16.

The alloyed steel powder having been treated through Surface Treating Step A2 was mixed with natural graphite. Thereto were added 0.15 wt % of calcium stearate (mp: 148–155° C.), and 0.2 wt % of one of a thermoplastic resin, a thermoplastic elastomer, and a material having a layer crystal structure of average particle diameter of about 10–20 μm as the lubricant, and blended (First Mixing Step). The mixture was heated to 160° C. with stirring (Melting Step), and was cooled to 85° C. or lower (Fixing Step).

Table 18–21 shows the employed lubricants (thermoplastic resins, thermoplastic elastomers, and materials having a layer crystal structure), and the amount thereof. In Tables 18–21, the lubricants are represented by the symbols shown in Table 17.

To the resulting powder mixture, were added at least one of lithium stearate (mp: 230° C.) and lithium hydroxystearate (mp: 216° C.) in a total amount of 0.4 wt % as the lubricant, and the mixture was blended uniformly, and discharged from the mixer (Second Mixing Step). The obtained powder compositions were referred to as Examples 64–67.

For comparison, powder compositions were prepared in the same manner as in Examples 64–67 except that the Surface Treating Step A2 was omitted (Comparative Examples 7, 9, 11, and 13). Further, powder compositions were prepared in the same manner as in Examples 64–67 except that the alloyed steel powder not treated through Surface Treating Step A2 and natural graphite were mixed without addition of a lubricant (Comparative Examples 8, 10, 12, and 14).

The flowability of the obtained powder composition was measured in the same manner as in Embodiment 1. Besides the flowability measurement, the powder composition discharged from the mixer was compacted with dies into tablets of 11 mm diameter by heating respectively to temperatures of 150° C., 180° C., and 21° C. at a compaction pressure of 7 ton/cm$^2$. The ejection force and the green density were measured in the same manner as above. Table 18–21 show the experimental results.

From comparison of Comparative Examples 7, 9, 11, and 13 respectively with Examples 64, 65, 66, and 67, it is clear that the flowability of the powder composition was improved markedly by the surface treatment of the present invention at the measured temperatures. From comparison of Comparative Examples 8, 10, 12, and 14 with Examples 64, 65, 66, and 67, it is clear that the powder compositions of the present invention had improved flowability and excellent compactibility in the temperature range from 150° C. to 210° C. owing to the effect of the surface treatment of the iron-based powder and the effect of the lubricant. The composition of Example 64, when compacted at a compaction temperature of 110° C. or 130° C., gave a lower green density, and when compacted at a compaction temperature of 240° C. or 260° C., required greater ejection force with lower compactibility. However, the composition of Example 64 was slightly better than that of Comparative Example 7 in the green density and the ejection force at the compaction temperatures of 110° C. and 130° C., and slightly better in the green density, and considerably better in the ejection force than that of Comparative Example 8 at the compaction temperature of 240° C., and 260° C.

(Embodiment 15)

An alloy steel powder of an average particle diameter of about 80 μm shown in Tables 22–25, and natural graphite having an average particle diameter of 23 μm were mixed together. To the mixture, a solution of a surface treatment agent containing an organoalkoxysilane, an organosilazane, a titanate coupling agent, a fluorine-containing silicon silane coupling agent, silicone fluid, or a mineral oil was sprayed in a proper amount (Surface Treating Step B3).

Tables 22–25 show the surface treatment agents used in Surface Treating Step B3, and the added amounts thereof. In Tables 22–25, the surface treatment agents are represented by the symbols shown in Table 16.

Each of the powder mixtures coated with the surface treatment agent was blended by a high-speed mixer at a mixing blade rotation speed of 1000 rpm for one minute. Thereto, were added 0.15 wt % of calcium stearate (mp: 148–155° C.), and 0.2 wt % of particles of an average diameter of about 10 μm of one of a thermoplastic resin, a thermoplastic elastomer, and a material having a layer crystal structure as the lubricant. The mixture was stirred (First Mixing Step). The mixture was heated to 160° C. with stirring (Melting Step), and was then cooled to 85° C. or lower with stirring (Fixing Step).

Tables 22–25 shows the employed lubricants (thermoplastic resins, thermoplastic elastomers, and materials having a layer crystal structure), and the amounts thereof. In Tables 22–25, the lubricants are represented by the symbols shown in Table 17.

To the resulting powder mixture, were added at least one of lithium stearate (mp: 230° C.), lithium hydroxystearate (mp: 216° C.), and calcium laurate (mp: 170° C.) in a total amount of 0.4 wt %. The mixture was blended uniformly, and discharged from the mixer (Second Mixing Step). The obtained powder compositions are referred to as Examples 68–71.

For comparison, powder compositions were prepared in the same manner as in Examples 68–71 except that the Surface Treating Step A2 was omitted (Comparative Examples 15, 17, 19, and 21). Separately for comparison, powder compositions were prepared in the same manner as in Examples 68–71 except that the alloyed steel powder not treated through Surface Treating Step A2 and natural graphite having an average particle diameter of about 23 μm were mixed together without addition of a lubricant (Comparative Examples 16, 18, 20, and 22).

The flowability of the obtained powder compositions was measured in the same manner as in Embodiment 1. Besides the flowability measurement, the powder composition discharged from the mixer was compacted with a die into a tablet of 11 mm diameter by heating to 180° C. at a compaction pressure of 7 ton/cm$^2$. The ejection force and the green density of the compact were measured in the same manner as above. Tables 22–25 show the experimental results.

From comparison of Comparative Examples 15, 17, 19, and 21 respectively with Examples 68, 69, 70, and 71, it is clear that the flowability of the powder composition was improved markedly by the surface treatment of the present invention at the measured temperatures. From comparison of Comparative Examples 16, 18, 20, and 22 respectively with Examples 68, 69, 70, and 71, it is clear that the powder compositions of the present invention had improved flowability and excellent compactibility owing to the effect of the surface treatment of the iron-based powder and the effect of the lubricant.

(Embodiment 16)

An alloy steel powder of an average particle diameter of about 80 μm shown in Tables 26–29, and natural graphite having an average particle diameter of 23 μm were mixed together. To the mixture, were added 0.20 wt % of calcium stearate (mp: 148–155° C.), and particles of an average diameter of about 10 μm of at least one of a thermoplastic resin, a thermoplastic elastomer, and a material having a layer crystal structure in a total amount of 0.2 wt % as the lubricant, and the mixture was stirred (First Mixing Step). Then the mixture was heated to 160° C. with stirring (Melting Step), and was then cooled to 110° C. with stirring. Thereon, a solution of a surface treatment agent containing an organoalkoxysilane, an organosilazane, a titanate coupling agent, a fluorine-containing silicon silane coupling agent, silicone fluid, or a mineral oil was sprayed in a proper amount, and the mixture was stirred by a high-speed mixer at a mixing blade rotation speed of 1000 rpm for one minute (Surface Treating Step C3).

Tables 26–29 show the employed lubricants (thermoplastic resins, thermoplastic elastomers, and materials having a layer crystal structure), and the added amounts thereof. In Tables 26–29, the lubricants are represented by the symbols shown in Table 17.

The mixture was cooled to 85° C. or lower (Fixing Step). To the resulting powder mixture, were added at least one of lithium stearate (mp: 230° C.), lithium hydroxystearate, and calcium laurate (mp: 170° C.) as a filler in a total amount of 0.3 wt % based on the weight of alloy steel powder, and the mixture was blended uniformly, and discharged from the mixer (Second Mixing Step). The obtained powder compositions are referred to as Examples 72–75.

Tables 26–29 show the surface treatment agents employed in Surface Treatment Step C3, and the added amounts thereof. In Tables 26–29, the surface treatment agents are represented by the symbols shown in Table 16.

For comparison, powder compositions were prepared in the same manner as in Examples 72–75 except that the Surface Treating Step C3 was omitted (Comparative Examples 23, 25, 27, and 29). Separately for comparison, powder compositions were prepared in the same manner as in Examples 72–75 except that the alloyed steel powder not treated through Surface Treating Step C3 and natural graphite of an average diameter of about 23 μm were mixed together without addition of a lubricant to obtain a powder composition (Comparative Examples 24, 26, 28, and 30).

The flowability of the obtained powder composition was determined in such a manner that 100 g of the powder composition was heated to a temperature ranging from 20° C. to 170° C., and measuring the time for the composition to pass entirely through an orifice of 5 mm. Besides the flowability measurement, the powder composition discharged from the mixer was compacted with a die into a tablet of 11 mm diameter by heating to 180° C. at a compaction pressure of 7 ton/cm$^2$. The ejection force and the green density of the compact were measured in the same manner as above. Tables 26–29 show the experimental results.

From comparison of Comparative Examples 23, 25, 27, and 29 respectively with Examples 72, 73, 74, and 75, it is clear that the flowability of the powder composition was improved markedly by the surface treatment of the present invention at the measured temperatures. From comparison of Comparative Examples 24, 26, 28, and 30 respectively with Examples 72, 73, 74, and 75, it is clear that the powder compositions of the present invention had improved flowability and excellent compactibility owing to the effect of the surface treatment of the iron-based powder and the effect of the lubricant.

(Embodiment 17)

A partially diffusion-alloyed steel powder (having component composition of Fe—4.0 wt % Ni—1.5 wt % Cu—0.5 wt % Mo) for powder metallurgy having an average particle diameter of about 80 μm, and natural graphite having an average particle diameter of 23 μm were mixed. Thereto, were added 0.15 wt % of stearic acid (mp: 70.1° C.), 0.15 wt % of lithium stearate (mp: 230° C.), and 0.15 wt % of a melamine-cyanuric acid adduct as the lubricant. The mixture was heated to 160° C. with stirring (First Mixing Step, and Melting Step).

The resulting mixture was cooled to 110° C. with stirring. To the powder mixture, a solution of a surface treatment agent containing an organoalkoxysilane was sprayed in a proper amount. The powder mixture was blended by a high-speed mixer at a mixing blade rotation speed of 1000 rpm for one minute (Surface Treating Step C3). Tables 30 and 31 show the surface treatment agents used in Surface Treating Step C3, and the added amounts thereof. In Tables 30 and 31, the surface treatment agents are represented by the symbols shown in Table 16.

The resulting powder mixture was cooled to 85° C. or lower (Fixing Step). To each of the powder mixtures obtained above, was added at least one of lithium stearate (mp: 230° C.) and calcium laurate (mp: 170° C.) in a total amount of 0.3 wt % as the lubricant, and the mixture was blended uniformly, and was discharged from the mixer (Second Mixing Step). The powder compositions are referred to as Examples 76 and 77.

For comparison, powder compositions were prepared in the same manner as in Examples 76–77 except that the Surface Treating Step C3 was omitted (Comparative Examples 31 and 33). Separately for comparison, powder compositions were prepared in the same manner as in Examples 76–77 except that the alloyed steel powder not treated through Surface Treating Step C3 and natural graphite were mixed without addition of a lubricant (Comparative Examples 32 and 34).

The flowability of the obtained powder composition was determined in such a manner that 100 g of the powder composition is heated to a temperature ranging from 20° C. to 150° C., and the time is measured for the composition to pass entirely through an orifice of 5 mm diameter. Besides the flowability measurement, the powder composition discharged from the mixer was compacted with a die into a tablet of 11 mm diameter by heating to 150° C. at a compaction pressure of 7 ton/cm$^2$. The ejection force and the green density of the compact were measured in the same manner as above. Tables 30–31 show the experimental results.

From comparison of Comparative Examples 31 and 33 with Examples 76 and 77, it is clear that the flowability of the powder composition was improved markedly by the surface treatment of the present invention at the measured temperatures. From comparison of Comparative Examples 32, and 34 with Example 76, and 77, it is clear that the powder composition prepared with iron powder surface-treated without addition of a lubricant has lower flowability, and lower green strength, and requires stronger ejection force, and that the composition of the present invention has improved flowability and excellent compactibility owing to the effect of the surface treatment of the iron-based powder and the effect of the lubricant.

Industrial Applicability

The present invention provides an iron-based powder composition for powder metallurgy having higher flowability and higher compactibility not only in ordinary temperature compaction but also in warm compaction, and provides also a process for producing the powder composition. Present invention provides further a process for compaction to produce a compact of a high density before sintering. Therefore, the present invention meets the demand for high-strength of sintered members, and is highly useful for industrial development.

TABLE 1

| | Iron powder (g) | Surface treatment* agent (wt % to iron powder) | Copper powder (g) | Surface treatment* agent (wt % to copper powder) | Graphite (g) | Surface treatment* agent (wt % to graphite powder) | Flow rate (sec/100 g) |
|---|---|---|---|---|---|---|---|
| Example 1 | 1000 | a (0.02) | 40 | — | 8 | — | 12.8 |
| Example 2 | 1000 | b (0.02) | 40 | — | 8 | — | 12.9 |
| Example 3 | 1000 | c (0.02) | 40 | — | 8 | — | 13.6 |
| Example 4 | 1000 | d (0.02) | 40 | — | 8 | — | 13.3 |
| Example 5 | 1000 | — | 40 | e (0.5) | 8 | — | 14.5 |
| Example 6 | 1000 | f (0.02) | 40 | a (0.5) | 8 | — | 12.4 |
| Example 7 | 1000 | j (0.01) | 40 | — | 8 | — | 14.3 |
| Example 8 | 1000 | — | 40 | — | 8 | c (0.4) | 14.2 |
| Example 9 | 1000 | e (0.02) | 40 | — | 8 | c (0.4) | 13.5 |
| Example 10 | 1000 | f (0.02) | 40 | a (0.5) | 8 | d (0.4) | 12.7 |
| Example 11 | 1000 | f (0.02) | 40 | l (0.5) | 8 | — | 14.1 |
| Comparative Example 1 | 1000 | — | 40 | — | 8 | — | 15.1 |
| | | | 40 | | | | |

(Note)
*Surface treatment agents are represented by the symbol shown in Table 16.

TABLE 2

| | Iron powder (g) | Copper powder (g) | Graphite (g) | Surface * treatment agent (wt % to iron powder) | Flow rate (sec/100 g) |
|---|---|---|---|---|---|
| Example 12 | 1000 | 20 | 6 | c (0.04) | 12.7 |
| Example 13 | 1000 | 20 | 6 | e (0.02) | 12.6 |
| Example 14 | 1000 | 20 | 6 | g (0.03) | 13.5 |
| Example 15 | 1000 | 20 | 6 | h (0.02) | 13.7 |
| Example 16 | 1000 | 20 | 6 | j (0.01) | 14.4 |
| Example 17 | 1000 | 20 | 6 | k (0.01) | 14.2 |
| Comparative Example 2 | 1000 | 20 | 6 | — | 14.7 |

(Note)
* Surfce treatment agents are represented by the symbol shown in Table 16.

TABLE 3

| | Iron powder (g) | Copper powder (g) | Graphite (g) | Surface * treatment agent (wt % to iron powder) | Flow rate (sec/100 g) |
|---|---|---|---|---|---|
| Example 18 | 1000 | 20 | 8 | c (0.03) | 13.3 |
| Example 19 | 1000 | 20 | 8 | e (0.02) | 13.4 |
| Example 20 | 1000 | 20 | 8 | f (0.02) | 13.1 |
| Example 21 | 1000 | 20 | 8 | i (0.02) | 13.5 |
| Example 22 | 1000 | 20 | 8 | k (0.01) | 13.3 |
| Comparative Example 3 | 1000 | 20 | 8 | — | 14.5 |

(Note)
* Surfce treatment agents are represented by the symbol shown in Table 16.

TABLE 4

| | Completely * alloyed steel powder (g) | Surface ** treatment agent (wt % to steel powder) | Graphite | Surface ** treatment (wt % to graphite powder) | Measurement temperature (° C.) | Flow rate (sec/100 g) |
|---|---|---|---|---|---|---|
| Example 23 | 1000 | a (0.02) | 5 | — | 20 | 11.7 |
| | | | | | 50 | 11.7 |
| | | | | | 80 | 11.8 |
| | | | | | 100 | 11.9 |
| | | | | | 120 | 12.0 |
| | | | | | 140 | 12.1 |
| Example 24 | 1000 | c (0.02) | 5 | d (0.5) | 20 | 11.6 |
| | | | | | 50 | 11.5 |
| | | | | | 80 | 11.6 |
| | | | | | 100 | 11.8 |
| | | | | | 120 | 11.9 |
| | | | | | 140 | 12.0 |
| Example 25 | 1000 | h (0.02) | 5 | — | 20 | 11.8 |
| | | | | | 50 | 11.8 |
| | | | | | 80 | 11.9 |
| | | | | | 100 | 12.0 |
| | | | | | 120 | 12.1 |
| | | | | | 140 | 12.2 |
| Example 26 | 1000 | m (0.01) | 5 | f (0.5) | 20 | 11.1 |
| | | | | | 50 | 11.3 |
| | | | | | 80 | 11.2 |
| | | | | | 100 | 11.8 |
| | | | | | 120 | 12.9 |
| | | | | | 140 | 12.1 |
| Example 27 | 1000 | — | 5 | g (0.5) | 20 | 11.5 |
| | | | | | 50 | 11.6 |
| | | | | | 80 | 11.8 |
| | | | | | 100 | 11.9 |
| | | | | | 120 | 12.0 |
| | | | | | 140 | 12.7 |
| Comparative Example 4 | 1000 | — | 5 | — | 20 | 12.5 |
| | | | | | 50 | 12.5 |
| | | | | | 80 | 12.8 |
| | | | | | 100 | 12.9 |
| | | | | | 120 | 13.1 |
| | | | | | 140 | 13.5 |

* Cr-Mn-Mo type completely alloyed steel powder
** Surface treatment agents are represented by the symbol shown in Table 16.

TABLE 5

| | Partially * alloyed steel powder (g) | Graphite (g) | Surface treatment ** agent (wt % to steel powder) | Measurement temperature (° C.) | Flow rate (sec/100 g) |
|---|---|---|---|---|---|
| Example 28 | 1000 | 6 | c (0.03) | 20 | 11.2 |
| | | | | 50 | 11.3 |
| | | | | 80 | 11.3 |
| | | | | 100 | 11.5 |
| | | | | 120 | 11.6 |
| | | | | 140 | 11.7 |
| Example 29 | 1000 | 6 | f (0.03) | 20 | 11.0 |
| | | | | 50 | 11.0 |
| | | | | 80 | 11.2 |
| | | | | 100 | 11.3 |
| | | | | 120 | 11.5 |
| | | | | 140 | 11.5 |
| Example 30 | 1000 | 6 | h (0.04) | 20 | 11.5 |
| | | | | 50 | 11.7 |
| | | | | 80 | 11.7 |
| | | | | 100 | 11.8 |
| | | | | 120 | 11.9 |
| | | | | 140 | 12.0 |
| Example 31 | 1000 | 6 | j (0.01) | 20 | 11.8 |
| | | | | 50 | 11.8 |
| | | | | 80 | 12.0 |
| | | | | 100 | 12.2 |
| | | | | 120 | 12.1 |
| | | | | 140 | 12.5 |

TABLE 5-continued

| | Partially * alloyed steel powder (g) | Graphite (g) | Surface treatment ** agent (wt % to steel powder) | Measurement temperature (° C.) | Flow rate (sec/100 g) |
|---|---|---|---|---|---|
| Comparative Example 5 | 1000 | 6 | — | 20 | 12.7 |
| | | | | 50 | 12.8 |
| | | | | 80 | 12.8 |
| | | | | 100 | 13.0 |
| | | | | 120 | 13.2 |
| | | | | 140 | 14.5 |

* Cu-Ni-Mo type partially diffusion-alloyed steel powder
** Surface treatment agents are represented by the symbol shown in Table 16.

TABLE 6

| | Partially * alloyed steel powder (g) | Graphite (g) | Surface treatment ** agent (wt % to graphite) | Measurement temperature (° C.) | Flow rate (sec/100 g) |
|---|---|---|---|---|---|
| Example 32 | 1000 | 6 | l (0.03) | 20 | 11.5 |
| | | | | 50 | 11.5 |
| | | | | 80 | 11.6 |
| | | | | 100 | 11.7 |
| | | | | 120 | 11.8 |
| | | | | 140 | 12.0 |
| Example 33 | 1000 | 6 | g (0.04) | 20 | 11.4 |
| | | | | 50 | 11.5 |
| | | | | 80 | 11.5 |
| | | | | 100 | 11.7 |
| | | | | 120 | 11.8 |
| | | | | 140 | 12.3 |
| Example 34 | 1000 | 6 | j (0.01) | 20 | 11.8 |
| | | | | 50 | 11.9 |
| | | | | 80 | 12.0 |
| | | | | 100 | 12.1 |
| | | | | 120 | 12.5 |
| | | | | 140 | 13.1 |

* Cu type partially diffusion-alloyed steel powder
* * Surface treatment agents are represented by the symbol shown in Table 16.

TABLE 7

| | Partially* alloyed steel powder (g) | Surface treatment** agent (wt % to steel powder) | Graphite (g) | Surface treatment** agent (wt % to graphite) | Lubricant*** (wt % to steel powder) | Measurement temperature (° C.) | Flow rate (sec/100 g) | Compactibility 150° C., 7 ton/cm$^2$ Green density (Mg/m$^3$) | Compactibility 150° C., 7 ton/cm$^2$ Ejection force (MPa) |
|---|---|---|---|---|---|---|---|---|---|
| Example 35 | 1000 | f (0.02) | 6 | — | i (0.1) | 20 | 11.8 | 7.30 | 29.0 |
| | | | | | | 50 | 11.9 | | |
| | | | | | | 80 | 11.9 | | |
| | | | | | | 100 | 12.1 | | |
| | | | | | | 120 | 12.3 | | |
| | | | | | | 140 | 12.5 | | |
| Example 36 | 1000 | h (0.02) | 6 | f (0.5) | iv (0.1) | 20 | 11.7 | 7.33 | 28.7 |
| | | | | | | 50 | 11.7 | | |
| | | | | | | 80 | 11.8 | | |
| | | | | | | 100 | 11.9 | | |
| | | | | | | 120 | 12.0 | | |
| | | | | | | 140 | 12.7 | | |
| Example 37 | 1000 | g (0.02) | 6 | — | vii (0.1) | 20 | 11.8 | 7.31 | 26.7 |
| | | | | | | 50 | 11.8 | | |
| | | | | | | 80 | 11.9 | | |
| | | | | | | 100 | 12.1 | | |
| | | | | | | 120 | 12.5 | | |
| | | | | | | 140 | 13.0 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 8

| | Partially* alloyed steel powder (g) | Surface treatment** agent (wt % to steel powder) | Graphite (g) | Surface treatment** agent (wt % to graphite) | Lubricant*** (wt % to steel powder) | Measurement temperature (° C.) | Flow rate (sec/100 g) | Compactibility 150° C., 7 ton/cm$^2$ Green density (Mg/m$^3$) | Ejection force (MPa) |
|---|---|---|---|---|---|---|---|---|---|
| Example 38 | 1000 | c (0.02) | 6 | — | xiii (0.1) | 20 | 11.9 | 7.32 | 31.2 |
| | | | | | | 50 | 11.9 | | |
| | | | | | | 80 | 12.0 | | |
| | | | | | | 100 | 12.1 | | |
| | | | | | | 120 | 12.3 | | |
| | | | | | | 140 | 12.5 | | |
| Example 39 | 1000 | i (0.02) | 6 | — | ix (0.1) | 20 | 11.8 | 7.33 | 33.5 |
| | | | | | | 50 | 11.7 | | |
| | | | | | | 80 | 11.9 | | |
| | | | | | | 100 | 12.0 | | |
| | | | | | | 120 | 12.2 | | |
| | | | | | | 140 | 12.3 | | |
| Comparative example 6 | 1000 | — | 6 | — | — | 20 | 12.7 | 7.28 | 40.2 |
| | | | | | | 50 | 12.7 | | |
| | | | | | | 80 | 12.8 | | |
| | | | | | | 100 | 12.9 | | |
| | | | | | | 120 | 13.5 | | |
| | | | | | | 140 | 14.8 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 9

| | Partially* alloyed steel powder (g) | Graphite (g) | Surface treatment** agent (wt % to steel powder) | Lubricant*** (wt % to steel powder) | Measurement temperature (° C.) | Flow rate (sec/100 g) | Compactibility 150° C., 7 ton/cm$^2$ Green density (Mg/m$^3$) | Ejection force (MPa) |
|---|---|---|---|---|---|---|---|---|
| Example 40 | 1000 | 6 | a (0.02) | ii (0.1) | 20 | 11.7 | 7.31 | 22.5 |
| | | | | | 50 | 11.7 | | |
| | | | | | 80 | 11.8 | | |
| | | | | | 100 | 11.9 | | |
| | | | | | 120 | 12.0 | | |
| | | | | | 140 | 12.5 | | |
| Example 41 | 1000 | 6 | d (0.03) | v (0.1) | 20 | 11.8 | 7.31 | 24.0 |
| | | | | | 50 | 11.8 | | |
| | | | | | 80 | 11.9 | | |
| | | | | | 100 | 12.0 | | |
| | | | | | 120 | 12.2 | | |
| | | | | | 140 | 12.7 | | |
| Example 42 | 1000 | 6 | h (0.02) | viii (0.1) | 20 | 12.1 | 7.30 | 26.3 |
| | | | | | 50 | 12.0 | | |
| | | | | | 80 | 12.1 | | |
| | | | | | 100 | 12.3 | | |
| | | | | | 120 | 12.5 | | |
| | | | | | 140 | 12.8 | | |
| Example 43 | 1000 | 6 | g (0.04) | xii (0.1) | 20 | 11.9 | 7.34 | 33.8 |
| | | | | | 50 | 12.0 | | |
| | | | | | 80 | 12.0 | | |
| | | | | | 100 | 12.1 | | |
| | | | | | 120 | 12.5 | | |
| | | | | | 140 | 12.9 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 10

| | Partially* alloyed steel powder (g) | Graphite (g) | Surface treatment** agent (wt % to steel powder) | Lubricant*** (wt % to steel powder) | Measurement temperature (° C.) | Flow rate (sec/100 g) | Compactibility 7 ton/cm$^2$ Compaction temperature (° C.) | Green density (Mg/m$^3$) | Ejection force (MPa) |
|---|---|---|---|---|---|---|---|---|---|
| Example 44 | 1000 | 6 | c (0.02) | iii (0.1) | | | 70 | 7.23 | 24.3 |
| | | | | | | | 90 | 7.25 | 25.7 |
| | | | | | 20 | 11.8 | 130 | 7.31 | 26.3 |
| | | | | | 50 | 11.9 | 150 | 7.32 | 26.0 |
| | | | | | 80 | 11.9 | 170 | 7.32 | 25.5 |
| | | | | | 100 | 12.0 | 190 | 7.34 | 25.1 |
| | | | | | 120 | 12.1 | 210 | 7.34 | 25.9 |
| | | | | | 140 | 12.7 | 220 | 7.34 | 40.1 |
| | | | | | | | 240 | 7.34 | 43.5 |
| Example 45 | 1000 | 6 | m (0.01) | v (0.1) | 20 | 12.0 | 130 | 7.30 | 25.5 |
| | | | | | 50 | 12.1 | 150 | 7.33 | 24.1 |
| | | | | | 80 | 12.1 | 170 | 7.33 | 23.6 |
| | | | | | 100 | 12.3 | 190 | 7.34 | 23.0 |
| | | | | | 120 | 12.5 | 210 | 7.34 | 24.7 |
| | | | | | 140 | 13.1 | | | |
| Example 46 | 1000 | 6 | e (0.02) | viii (0.1) | 20 | 12.1 | | | |
| | | | | | 50 | 12.1 | | | |
| | | | | | 80 | 12.2 | 130 | 7.28 | 28.5 |
| | | | | | 100 | 12.5 | 150 | 7.30 | 27.0 |
| | | | | | 120 | 12.7 | 170 | 7.31 | 26.6 |
| | | | | | 140 | 13.3 | 190 | 7.30 | 26.8 |
| | | | | | | | 210 | 7.31 | 27.3 |

(Note)
*Partially diffusion-alloyed steel powder having component composition of Fe—4.0 wt % Ni—1.5 wt % Cu—0.5 wt % Mo
**Surface treatment agents are represented by the symbol shown in Table 16.
***Lubricant includes thermoplastic resins, thermoplastic elastomers, materials having layer crystal structure, represented by the symbol shown in Table 17.

TABLE 11

| | Partially* alloyed steel powder (g) | Graphite (g) | Surface treatment** agent (wt % to steel powder) | Lubricant*** (wt % to steel powder) | Measurement temperature (° C.) | Flow rate (sec/100 g) | Compactibility 150° C., 7 ton/cm$^2$ Green density (Mg/m$^3$) | Ejection force (MPa) |
|---|---|---|---|---|---|---|---|---|
| Example 47 | 1000 | 6 | g (0.02) | i (0.05) | 20 | 12.0 | 7.31 | 23.5 |
| | | | | xiii (0.05) | 50 | 11.9 | | |
| | | | | | 80 | 12.0 | | |
| | | | | | 100 | 12.1 | | |
| | | | | | 120 | 12.3 | | |
| | | | | | 140 | 12.7 | | |
| Example 48 | 1000 | 6 | f (0.02) | iii (0.1) | 20 | 12.1 | 7.32 | 25.1 |
| | | | | | 50 | 12.1 | | |
| | | | | | 80 | 12.1 | | |
| | | | | | 100 | 12.4 | | |
| | | | | | 120 | 12.8 | | |
| | | | | | 140 | 13.5 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 12

| | Partially* alloyed steel powder (g) | Surface treatment** agent (wt % to steel powder) | Graphite (g) | Surface treatment** agent (wt % to graphite powder) | Lubricant*** (wt % to steel powder) | Measurement temperature (° C.) | Flow rate (sec/100 g) | Compactibility 150° C., 7 ton/cm$^2$ Green density (Mg/m$^3$) | Ejection force (MPa) |
|---|---|---|---|---|---|---|---|---|---|
| Example 49 | 1000 | e (0.02) | 6 | — | iv (0.1) | 20 | 11.7 | 7.32 | 35.3 |
| | | | | | | 50 | 11.5 | | |
| | | | | | | 80 | 11.8 | | |

TABLE 12-continued

| | Partially* alloyed steel powder (g) | Surface treatment** agent (wt % to steel powder) | Graphite (g) | Surface treatment** agent (wt % to graphite powder) | Lubricant*** (wt % to steel powder) | Measurement temperature (° C.) | Flow rate (sec/100 g) | Compactibility 150° C., 7 ton/cm$^2$ Green density (Mg/m$^3$) | Ejection force (MPa) |
|---|---|---|---|---|---|---|---|---|---|
| | | | | | | 100 | 11.9 | | |
| | | | | | | 120 | 12.0 | | |
| | | | | | | 140 | 12.5 | | |
| Example 50 | 1000 | k (0.02) | 6 | g (0.5) | v (0.1) | 20 | 11.4 | 7.32 | 33.3 |
| | | | | | | 50 | 11.5 | | |
| | | | | | | 80 | 11.5 | | |
| | | | | | | 100 | 11.7 | | |
| | | | | | | 120 | 11.9 | | |
| | | | | | | 140 | 12.3 | | |
| Example 51 | 1000 | g (0.02) | 6 | — | x (0.1) | 20 | 11.5 | 7.33 | 37.1 |
| | | | | | | 50 | 11.5 | | |
| | | | | | | 80 | 11.6 | | |
| | | | | | | 100 | 11.7 | | |
| | | | | | | 120 | 12.0 | | |
| | | | | | | 140 | 12.7 | | |
| Example 52 | 1000 | c (0.02) | 6 | — | xii (0.1) | 20 | 11.3 | 7.34 | 35.1 |
| | | | | | | 50 | 11.3 | | |
| | | | | | | 80 | 11.5 | | |
| | | | | | | 100 | 11.6 | | |
| | | | | | | 120 | 11.8 | | |
| | | | | | | 140 | 12.9 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 13

| | Partially* alloyed steel powder (g) | Graphite (g) | Surface treatment** agent (wt % to steel powder) | Lubricant*** (wt % to steel powder) | Measurement temperature (° C.) | Flow rate (sec/100 g) | Compactibility 150° C., 7 ton/cm$^2$ Green density (Mg/m$^3$) | Ejection force (MPa) |
|---|---|---|---|---|---|---|---|---|
| Example 53 | 1000 | 6 | c (0.03) | ii (0.1) | 20 | 11.8 | 7.31 | 34.2 |
| | | | | | 50 | 11.8 | | |
| | | | | | 80 | 11.9 | | |
| | | | | | 100 | 12.0 | | |
| | | | | | 120 | 12.2 | | |
| | | | | | 140 | 12.9 | | |
| Example 54 | 1000 | 6 | f (0.02) | iv (0.05) xiii (0.05) | 20 | 11.9 | 7.30 | 33.1 |
| | | | | | 50 | 11.9 | | |
| | | | | | 80 | 11.9 | | |
| | | | | | 100 | 12.1 | | |
| | | | | | 120 | 12.7 | | |
| | | | | | 140 | 13.2 | | |
| Example 55 | 1000 | 6 | h (0.03) | iv (0.1) | 20 | 11.9 | 7.33 | 30.1 |
| | | | | | 50 | 12.0 | | |
| | | | | | 80 | 12.0 | | |
| | | | | | 100 | 12.5 | | |
| | | | | | 120 | 12.8 | | |
| | | | | | 140 | 13.5 | | |
| Example 56 | 1000 | 6 | j (0.01) | xiv (0.1) | 20 | 12.1 | 7.32 | 29.5 |
| | | | | | 50 | 12.5 | | |
| | | | | | 80 | 12.5 | | |
| | | | | | 100 | 12.7 | | |
| | | | | | 120 | 12.9 | | |
| | | | | | 140 | 13.9 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 14

| | Partially* alloyed steel powder (g) | Graphite (g) | Surface treatment** agent (wt % to steel powder) | Lubricant*** (wt % to steel powder) | Measurement temperature (° C.) | Flow rate (sec/100 g) | Compactibility 150° C., 7 ton/cm$^2$ Green density (Mg/m$^3$) | Compactibility 150° C., 7 ton/cm$^2$ Ejection force (MPa) |
|---|---|---|---|---|---|---|---|---|
| Example 57 | 1000 | 6 | b (0.02) | i (0.1) | 20 | 11.9 | 7.32 | 28.7 |
| | | | | | 50 | 12.0 | | |
| | | | | | 80 | 12.0 | | |
| | | | | | 100 | 12.2 | | |
| | | | | | 120 | 12.5 | | |
| | | | | | 140 | 13.0 | | |
| Example 58 | 1000 | 6 | d (0.03) | v (0.1) | 20 | 12.0 | 7.33 | 26.5 |
| | | | | | 50 | 12.0 | | |
| | | | | | 80 | 12.0 | | |
| | | | | | 100 | 12.2 | | |
| | | | | | 120 | 12.7 | | |
| | | | | | 140 | 13.5 | | |
| Example 59 | 1000 | 6 | h (0.02) | vi (0.1) | 20 | 11.8 | 7.31 | 20.1 |
| | | | | | 50 | 12.0 | | |
| | | | | | 80 | 11.9 | | |
| | | | | | 100 | 12.4 | | |
| | | | | | 120 | 12.7 | | |
| | | | | | 140 | 13.0 | | |

(Note)
*Cu—Ni—Mo type partially diffusion-alloyed steel powder
**Surface treatment agents are represented by the symbol shown in Table 16.
***Lubricant includes thermoplastic resins, thermoplastic elastomers, materials having layer crystal structure, represented by the symbol shown in Table 17.

TABLE 15

| | Partially* alloyed steel powder (g) | Graphite (g) | Surface treatment** agent (wt % to steel powder) | Measurement temperature (° C.) | Flow rate (sec/100 g) | Compactibility 150° C., 7 ton/cm$^2$ Green density (Mg/m$^3$) | Compactibility 150° C., 7 ton/cm$^2$ Ejection force (MPa) |
|---|---|---|---|---|---|---|---|
| Example 60 | 1000 | 6 | c (0.03) | 20 | 11.5 | 7.33 | 31.0 |
| | | | | 50 | 11.5 | | |
| | | | | 80 | 11.6 | | |
| | | | | 100 | 11.7 | | |
| | | | | 120 | 11.8 | | |
| | | | | 140 | 11.9 | | |
| Example 61 | 1000 | 6 | f (0.04) | 20 | 11.4 | 7.35 | 29.7 |
| | | | | 50 | 11.5 | | |
| | | | | 80 | 11.6 | | |
| | | | | 100 | 11.6 | | |
| | | | | 120 | 11.9 | | |
| | | | | 140 | 12.7 | | |
| Example 62 | 1000 | 6 | m (0.01) | 20 | 11.8 | 7.34 | 32.3 |
| | | | | 50 | 11.9 | | |
| | | | | 80 | 11.9 | | |
| | | | | 100 | 12.0 | | |
| | | | | 120 | 13.0 | | |
| | | | | 140 | 13.5 | | |
| Example 63 | 1000 | 6 | j (0.01) | 20 | 11.8 | 7.33 | 31.5 |
| | | | | 50 | 11.8 | | |
| | | | | 80 | 11.7 | | |
| | | | | 100 | 11.9 | | |
| | | | | 120 | 12.5 | | |
| | | | | 140 | 12.8 | | |

(Note)
*Cu—Ni—Mo type partially diffusion-alloyed steel powder
**Surface treatment agents are represented by the symbol shown in Table 16.

TABLE 16

| Group name | Symbol | Specific name |
|---|---|---|
| Organoalkoxysilane | a | γ-Methacryloxypropyl-trimethoxysilane |
| | b | γ-glycidoxypropyl-trimethoxysilane |
| | c | N-β (aminoethyl)- γ -amino-propyl-trimethoxysilane |
| | d | Methyltrimethoxysilane |
| | e | Phenyltrimethoxysilane |
| | f | Diphenyldimethoxysilane |
| | g | 1H, 1H, 2H, 2H, -Henicosa-fluorotrimethoxysilane |
| Organosilazane | h | polyorganosilazane |
| Titanate coupling agent | i | isopropyltriisostearoyl titanate |
| Alkybenzene | j | Alxylbenzene |
| Silicone fluid | k | Dimethylsilicone fluid |
| | l | Methylphenyl silicone fluid |
| | m | Fluorine meditied silicone fluid |

TABLE 17

| Group name | Symbol | Specific name |
|---|---|---|
| Inorganic compound having | i | Graphite |
| | ii | Carbon fluoride |

TABLE 17-continued

| Group name | Symbol | Specific name |
|---|---|---|
| layer crystal structure | iii | $MoS_2$ |
| Organic compound having layer crystal structure | iv | Melamine-cyanuric acid adduct |
| | v | β -alkyl N-alkylasparaic acid |
| Thermoplastic resin | vi | Polystyrene powder |
| | vii | Nylon powder |
| | viii | Polyethylene powder |
| | ix | Fluoroplastic powder |
| Thermoplastic elastomer | x | Polystyrene-acrylate copolymer |
| | xi | Thermoplastic elastomer ofefin (TEO) |
| | xii | Thermoplastic elastomer SBS * |
| | xiii | Thermoplastic elastomer silicone |
| | xiv | Thermoplastic elastomer polyamide(TPAE) |

* SBS * Polystyrene-polybutadiene-polystrene

TABLE 18

| | Partially* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 7 ton/cm$^2$ Compaction temperature (° C.) | Green density (Mg/m$^3$) | Ejection force (MPa) |
|---|---|---|---|---|---|---|---|---|---|---|
| Example 64 | 1000 | 5.0 | f (0.02) | ix (0.2) | Lithium hydroxystearate (0.4) | 20 | 11.5 | 110 | 7.33 | 20.7 |
| | | | | | | 50 | 11.5 | 130 | 7.35 | 21.8 |
| | | | | | | 80 | 11.5 | 150 | 7.39 | 22.5 |
| | | | | | | 100 | 12.5 | 180 | 7.40 | 23.1 |
| | | | | | | 130 | 11.6 | 210 | 7.41 | 24.7 |
| | | | | | | 150 | 11.8 | 240 | 7.41 | 32.2 |
| | | | | | | 170 | 12.9 | 260 | 7.41 | 35.0 |
| Comparative Example 7 | 1000 | 5.0 | — | ix (0.2) | Lithium hydroxystearate (0.4) | 20 | 12.0 | 110 | 7.32 | 23.0 |
| | | | | | | 50 | 12.1 | 130 | 7.33 | 24.8 |
| | | | | | | 80 | 12.2 | 150 | 7.38 | 25.6 |
| | | | | | | 100 | 12.1 | 180 | 7.39 | 26.1 |
| | | | | | | 130 | 12.3 | 210 | 7.40 | 28.3 |
| | | | | | | 150 | 12.5 | | | |
| | | | | | | 170 | 14.0 | | | |
| Comparative Example 8 | 1000 | 5.0 | — | — | — | 20 | 12.5 | 150 | 7.35 | 41.3 |
| | | | | | | 50 | 12.6 | 180 | 7.36 | 43.0 |
| | | | | | | 80 | 12.7 | 210 | 7.36 | 50.6 |
| | | | | | | 100 | 12.6 | 240 | 7.39 | 51.0 |
| | | | | | | 130 | 12.8 | 260 | 7.40 | 53.0 |
| | | | | | | 150 | 13.0 | | | |
| | | | | | | 170 | 14.5 | | | |

(Note)

*Partially diffusion-alloyed steel powder having component composition of Fe—4.0 wt % Ni—1.5 wt % Cu—0.5 wt % Mo

**Surface treatment agents are represented by the symbol shown in Table 16.

***Lubricant includes thermoplastic resins, thermoplastic elastomers, materials having layer crystal structure, represented by the symbol shown in Table 17.

TABLE 19

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 7 ton/cm$^2$ Compaction temperature (° C.) | Green density (Mg/m$^3$) | Ejection force (MPa) |
|---|---|---|---|---|---|---|---|---|---|---|
| Example 65 | 1000 | 4.0 | e (0.03) | iv (0.2) | Lithium stearate (0.4) | 20 | 10.8 | 150 | 7.14 | 21.2 |
| | | | | | | 50 | 10.8 | | | |
| | | | | | | 80 | 10.9 | 180 | 7.16 | 22.7 |
| | | | | | | 100 | 10.8 | | | |
| | | | | | | 130 | 10.9 | 210 | 7.17 | 23.4 |
| | | | | | | 150 | 11.1 | | | |
| | | | | | | 170 | 12.2 | | | |
| Comparative Example 9 | 1000 | 4.0 | — | iv (0.2) | Lithium stearate (0.4) | 20 | 11.7 | 150 | 7.13 | 25.4 |
| | | | | | | 50 | 11.8 | | | |
| | | | | | | 80 | 11.9 | 180 | 7.15 | 26.5 |
| | | | | | | 100 | 11.8 | | | |
| | | | | | | 130 | 12.0 | 210 | 7.16 | 28.1 |
| | | | | | | 150 | 12.2 | | | |
| | | | | | | 170 | 13.7 | | | |
| Comparative Example 10 | 1000 | 4.0 | — | — | — | 20 | 12.5 | 150 | 7.10 | 39.1 |
| | | | | | | 50 | 12.6 | | | |
| | | | | | | 80 | 12.7 | 180 | 7.11 | 42.1 |
| | | | | | | 100 | 12.6 | | | |
| | | | | | | 130 | 12.8 | 210 | 7.13 | 59.3 |
| | | | | | | 150 | 13.0 | | | |
| | | | | | | 170 | 14.5 | | | |

(Note)
*Completely alloyed steel powder having component composition of Fe—3.0 wt % Cr—0.4 wt % Mo—0.3 wt % V
**Surface treatment agents are represented by the symbol shown in Table 16.
***Lubricant includes thermoplastic resins, thermoplastic elastomers, materials having layer crystal structure, represented by the symbol shown in Table 17.

TABLE 20

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 7 ton/cm$^2$ Compaction temperature (° C.) | Green density (Mg/m$^3$) | Ejection force (MPa) |
|---|---|---|---|---|---|---|---|---|---|---|
| Example 66 | 1000 | 4.0 | d (0.03) | iv (0.2) | Lithium hydroxystearate (0.2) + Lithium stearate (0.2) | 20 | 10.7 | 150 | 7.15 | 20.6 |
| | | | | | | 50 | 10.7 | | | |
| | | | | | | 80 | 10.8 | 180 | 7.16 | 21.5 |
| | | | | | | 100 | 10.7 | | | |
| | | | | | | 130 | 10.8 | 210 | 7.17 | 23.0 |
| | | | | | | 150 | 11.0 | | | |
| | | | | | | 170 | 12.1 | | | |
| Comparative Example 11 | 1000 | 4.0 | — | iv (0.2) | Lithium hydroxystearate (0.2) + Lithium stearate (0.2) | 20 | 11.5 | 150 | 7.14 | 25.4 |
| | | | | | | 50 | 11.6 | | | |
| | | | | | | 80 | 11.7 | 180 | 7.15 | 26.3 |
| | | | | | | 100 | 11.6 | | | |
| | | | | | | 130 | 11.8 | 210 | 7.17 | 28.0 |
| | | | | | | 150 | 12.0 | | | |
| | | | | | | 170 | 13.5 | | | |
| Comparative Example 12 | 1000 | 4.0 | — | — | — | 20 | 12.4 | 150 | 7.09 | 40.9 |
| | | | | | | 50 | 12.5 | | | |
| | | | | | | 80 | 12.6 | 180 | 7.10 | 45.0 |
| | | | | | | 100 | 12.5 | | | |
| | | | | | | 130 | 12.7 | 210 | 7.10 | 53.8 |
| | | | | | | 150 | 12.9 | | | |
| | | | | | | 170 | 14.6 | | | |

(Note)
*Completely alloyed steel powder having component composition of Fe—6.5 wt % Co—1.5 wt % Ni—1.5 wt % Mo—0.2 wt % Cu
**Surface treatment agents are represented by the symbol shown in Table 16.
***Lubricant includes thermoplastic resins, thermoplastic elastomers, materials having layer crystal structure, represented by the symbol shown in Table 17.

TABLE 21

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 7 ton/cm² Compaction temperature (° C.) | Green density (Mg/m³) | Ejection force (MPa) |
|---|---|---|---|---|---|---|---|---|---|---|
| Example 67 | 1000 | 4.0 | l (0.02) | ii (0.2) | Lithium stearate (0.4) | 20 | 10.5 | 150 | 7.23 | 19.8 |
| | | | | | | 50 | 10.4 | | | |
| | | | | | | 80 | 10.5 | 180 | 7.24 | 22.4 |
| | | | | | | 100 | 10.4 | | | |
| | | | | | | 130 | 10.5 | 210 | 7.24 | 24.3 |
| | | | | | | 150 | 10.7 | | | |
| | | | | | | 170 | 11.8 | | | |
| Comparative Example 13 | 1000 | 4.0 | — | ii (0.2) | Lithium stearate (0.4) | 20 | 11.7 | 150 | 7.20 | 22.7 |
| | | | | | | 50 | 11.8 | | | |
| | | | | | | 80 | 11.9 | 180 | 7.21 | 25.0 |
| | | | | | | 100 | 11.8 | | | |
| | | | | | | 130 | 12.0 | 210 | 7.22 | 28.8 |
| | | | | | | 150 | 12.2 | | | |
| | | | | | | 170 | 13.7 | | | |
| Comparative Example 14 | 1000 | 4.0 | — | — | — | 20 | 12.4 | 150 | 7.16 | 34.5 |
| | | | | | | 50 | 12.5 | | | |
| | | | | | | 80 | 12.6 | 180 | 7.17 | 38.0 |
| | | | | | | 100 | 12.5 | | | |
| | | | | | | 130 | 12.7 | 210 | 7.18 | 45.2 |
| | | | | | | 150 | 12.9 | | | |
| | | | | | | 170 | 15.1 | | | |

(Note)
*Completely alloyed steel powder having component composition of Fe—1.0 wt % Ni—0.4 wt % Cu—0.4 wt % Mo
**Surface treatment agents are represented by the symbol shown in Table 16.
***Lubricant includes thermoplastic resins, thermoplastic elastomers, materials having layer crystal structure, represented by the symbol shown in Table 17.

TABLE 22

| | Partially* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Ejection force (MPa) |
|---|---|---|---|---|---|---|---|---|---|
| Example 68 | 1000 | 5.0 | k (0.02) | xiii (0.2) | Lithium stearate (0.4) | 20 | 11.5 | 7.37 | 19.5 |
| | | | | | | 50 | 11.5 | | |
| | | | | | | 80 | 11.6 | | |
| | | | | | | 100 | 11.5 | | |
| | | | | | | 130 | 11.6 | | |
| | | | | | | 150 | 11.9 | | |
| | | | | | | 170 | 13.1 | | |
| Comparative Example 15 | 1000 | 5.0 | — | xiii (0.2) | Lithium stearate (0.4) | 20 | 12.2 | 7.35 | 22.1 |
| | | | | | | 50 | 12.2 | | |
| | | | | | | 80 | 12.3 | | |
| | | | | | | 100 | 12.2 | | |
| | | | | | | 130 | 12.3 | | |
| | | | | | | 150 | 12.6 | | |
| | | | | | | 170 | 13.8 | | |
| Comparative Example 16 | 1000 | 5.0 | — | — | — | 20 | 13.1 | 7.27 | 39.5 |
| | | | | | | 50 | 13.2 | | |
| | | | | | | 80 | 13.3 | | |
| | | | | | | 100 | 13.2 | | |
| | | | | | | 130 | 13.4 | | |
| | | | | | | 150 | 14.1 | | |
| | | | | | | 170 | 16.3 | | |

(Note)
*Partially diffusion-alloyed steel powder having component composition of Fe—2.0 wt % Ni—1.0 wt % Mo
**Surface treatment agents are represented by the symbol shown in Table 16.
***Lubricant includes thermoplastic resins, thermoplastic elastomers, materials having layer crystal structure, represented by the symbol shown in Table 17.

TABLE 23

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Compactibility 180° C., 7 ton/cm² Ejection force (MPa) |
|---|---|---|---|---|---|---|---|---|---|
| Example 69 | 1000 | 4.0 | g (0.03) | vii (0.2) | Lithium hydroxystearate (0.4) | 20 | 10.9 | 7.15 | 19.7 |
| | | | | | | 50 | 10.8 | | |
| | | | | | | 80 | 10.9 | | |
| | | | | | | 100 | 10.9 | | |
| | | | | | | 130 | 11.0 | | |
| | | | | | | 150 | 11.3 | | |
| | | | | | | 170 | 12.5 | | |
| Comparative Example 17 | 1000 | 4.0 | — | vii (0.2) | Lithium hydroxystearate (0.4) | 20 | 11.6 | 7.13 | 22.6 |
| | | | | | | 50 | 11.6 | | |
| | | | | | | 80 | 11.7 | | |
| | | | | | | 100 | 11.6 | | |
| | | | | | | 130 | 11.7 | | |
| | | | | | | 150 | 12.0 | | |
| | | | | | | 170 | 13.2 | | |
| Comparative Example 18 | 1000 | 4.0 | — | — | — | 20 | 12.5 | 7.04 | 38.4 |
| | | | | | | 50 | 12.6 | | |
| | | | | | | 80 | 12.7 | | |
| | | | | | | 100 | 12.6 | | |
| | | | | | | 130 | 12.8 | | |
| | | | | | | 150 | 13.5 | | |
| | | | | | | 170 | 14.9 | | |

(Note)
*Completely alloyed steel powder having component composition of Fe—3.0 wt % Cr—0.4 wt % Mo—0.3 wt % V
**Surface treatment agents are represented by the symbol shown in Table 16.
***Lubricant includes thermoplastic resins, thermoplastic elastomers, materials having layer crystal structure, represented by the symbol shown in Table 17.

TABLE 24

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Compactibility 180° C., 7 ton/cm² Ejection force (MPa) |
|---|---|---|---|---|---|---|---|---|---|
| Example 70 | 1000 | 4.0 | e (0.04) | x (0.2) | Calcium laurate (0.4) | 20 | 10.4 | 7.14 | 18.9 |
| | | | | | | 50 | 10.8 | | |
| | | | | | | 80 | 10.9 | | |
| | | | | | | 100 | 10.9 | | |
| | | | | | | 130 | 11.0 | | |
| | | | | | | 150 | 11.3 | | |
| | | | | | | 170 | 12.5 | | |
| Comparative Example 19 | 1000 | 4.0 | — | x (0.2) | Calcium laurate (0.4) | 20 | 11.1 | 7.12 | 23.1 |
| | | | | | | 50 | 11.1 | | |
| | | | | | | 80 | 11.2 | | |
| | | | | | | 100 | 11.1 | | |
| | | | | | | 130 | 11.2 | | |
| | | | | | | 150 | 11.5 | | |
| | | | | | | 170 | 12.7 | | |
| Comparative Example 20 | 1000 | 4.0 | — | — | — | 20 | 12.3 | 7.08 | 35.5 |
| | | | | | | 50 | 12.4 | | |
| | | | | | | 80 | 12.5 | | |
| | | | | | | 100 | 12.4 | | |
| | | | | | | 130 | 12.6 | | |
| | | | | | | 150 | 13.3 | | |
| | | | | | | 170 | 14.5 | | |

(Note)
*Completely alloyed steel powder having component composition of Fe—6.5 wt % Co—1.5 wt % Ni—1.5 wt % Mo—0.2 wt % Cu
**Surface treatment agents are represented by the symbol shown in Table 16.
***Lubricant includes thermoplastic resins, thermoplastic elastomers, materials having layer crystal structure, represented by the symbol shown in Table 17.

TABLE 25

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Compactibility 180° C., 7 ton/cm² Ejection force (MPa) |
|---|---|---|---|---|---|---|---|---|---|
| Example 71 | 1000 | 4.0 | f (0.03) | x (0.2) | Lithium stearate (0.3) + Calcium laurate (0.1) | 20 | 10.7 | 7.23 | 21.3 |
| | | | | | | 50 | 10.8 | | |
| | | | | | | 80 | 10.9 | | |
| | | | | | | 100 | 10.9 | | |
| | | | | | | 130 | 11.0 | | |
| | | | | | | 150 | 11.3 | | |
| | | | | | | 170 | 12.5 | | |
| Comparative Example 21 | 1000 | 4.0 | — | x (0.2) | Lithium stearate (0.3) + Calcium laurate (0.1) | 20 | 11.5 | 7.21 | 25.4 |
| | | | | | | 50 | 11.5 | | |
| | | | | | | 80 | 11.6 | | |
| | | | | | | 100 | 11.5 | | |
| | | | | | | 130 | 11.6 | | |
| | | | | | | 150 | 11.9 | | |
| | | | | | | 170 | 13.1 | | |
| Comparative Example 22 | 1000 | 4.0 | — | — | — | 20 | 12.2 | 7.15 | 37.6 |
| | | | | | | 50 | 12.3 | | |
| | | | | | | 80 | 12.4 | | |
| | | | | | | 100 | 12.3 | | |
| | | | | | | 130 | 12.5 | | |
| | | | | | | 150 | 13.2 | | |
| | | | | | | 170 | 14.7 | | |

(Note)
*Completely alloyed steel powder having component composition of Fe—1.0 wt % Ni—0.4 wt % Cu—0.4 wt % Mo
**Surface treatment agents are represented by the symbol shown in Table 16.
***Lubricant includes thermoplastic resins, thermoplastic elastomers, materials having layer crystal structure, represented by the symbol shown in Table 17.

TABLE 26

| | Partially* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Compactibility 180° C., 7 ton/cm² Ejection force (MPa) |
|---|---|---|---|---|---|---|---|---|---|
| Example 72 | 1000 | 3.0 | h (0.02) | iv (0.15) vi (0.05) | Lithium stearate (0.3) | 20 | 11.1 | 7.43 | 21.1 |
| | | | | | | 50 | 11.1 | | |
| | | | | | | 80 | 11.2 | | |
| | | | | | | 100 | 11.1 | | |
| | | | | | | 130 | 11.2 | | |
| | | | | | | 150 | 11.5 | | |
| | | | | | | 170 | 12.7 | | |
| Comparative Example 23 | 1000 | 3.0 | — | iv (0.15) vi (0.05) | Lithium stearate (0.3) | 20 | 11.8 | 7.40 | 24.1 |
| | | | | | | 50 | 11.8 | | |
| | | | | | | 80 | 11.9 | | |
| | | | | | | 100 | 11.8 | | |
| | | | | | | 130 | 11.9 | | |
| | | | | | | 150 | 12.2 | | |
| | | | | | | 170 | 13.4 | | |
| Comparative Example 24 | 1000 | 3.0 | — | — | — | 20 | 12.1 | 7.36 | 40.5 |
| | | | | | | 50 | 12.2 | | |
| | | | | | | 80 | 12.3 | | |
| | | | | | | 100 | 12.3 | | |
| | | | | | | 130 | 12.5 | | |
| | | | | | | 150 | 13.1 | | |
| | | | | | | 170 | 15.3 | | |

(Note)
*Partially diffusion-alloyed steel powder having component composition of Fe—4.0 wt % Ni—1.5 wt % Cu—0.5 wt % Mo
**Surface treatment agents are represented by the symbol shown in Table 16.
***Lubricant includes thermoplastic resins, thermoplastic elastomers, materials having layer crystal structure, represented by the symbol shown in Table 17.

TABLE 27

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Ejection force (MPa) |
|---|---|---|---|---|---|---|---|---|---|
| Example 73 | 1000 | 4.2 | g (0.01) | v (0.2) | Lithium stearate (0.2) + Lithium hydroxystearate (0.1) | 20 | 10.6 | 7.22 | 18.7 |
| | | | | | | 50 | 10.6 | | |
| | | | | | | 80 | 10.7 | | |
| | | | | | | 100 | 10.9 | | |
| | | | | | | 130 | 11.0 | | |
| | | | | | | 150 | 11.3 | | |
| | | | | | | 170 | 12.5 | | |
| Comparative Example 25 | 1000 | 4.2 | — | v (0.2) | Lithium stearate (0.2) + Lithium hydroxystearate (0.1) | 20 | 11.5 | 7.19 | 21.8 |
| | | | | | | 50 | 11.4 | | |
| | | | | | | 80 | 11.5 | | |
| | | | | | | 100 | 11.6 | | |
| | | | | | | 130 | 11.7 | | |
| | | | | | | 150 | 12.0 | | |
| | | | | | | 170 | 13.2 | | |
| Comparative Example 26 | 1000 | 4.2 | — | — | — | 20 | 12.1 | 7.14 | 38.1 |
| | | | | | | 50 | 12.2 | | |
| | | | | | | 80 | 12.3 | | |
| | | | | | | 100 | 12.2 | | |
| | | | | | | 130 | 12.4 | | |
| | | | | | | 150 | 13.1 | | |
| | | | | | | 170 | 14.9 | | |

(Note)
*Completely alloyed steel powder having component composition of Fe—2.0 wt % Cu—0.7 wt % Mn—0.3 wt % Mo
**Surface treatment agents are represented by the symbol shown in Table 16.
***Lubricant includes thermoplastic resins, thermoplastic elastomers, materials having layer crystal structure, represented by the symbol shown in Table 17.

TABLE 28

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm² Green density (Mg/m³) | Ejection force (MPa) |
|---|---|---|---|---|---|---|---|---|---|
| Example 74 | 1000 | 3.8 | e (0.04) | iv (0.1) x (0.1) | Lithium stearate (0.2) + Calcium laurate (0.1) | 20 | 10.7 | 7.25 | 21.0 |
| | | | | | | 50 | 10.7 | | |
| | | | | | | 80 | 10.8 | | |
| | | | | | | 100 | 10.8 | | |
| | | | | | | 130 | 10.9 | | |
| | | | | | | 150 | 11.2 | | |
| | | | | | | 170 | 12.4 | | |
| Comparative Example 27 | 1000 | 3.8 | — | iv (0.1) x (0.1) | Lithium stearate (0.2) + Calcium laurate (0.1) | 20 | 11.1 | 7.24 | 24.2 |
| | | | | | | 50 | 11.1 | | |
| | | | | | | 80 | 11.2 | | |
| | | | | | | 100 | 11.1 | | |
| | | | | | | 130 | 11.2 | | |
| | | | | | | 150 | 11.5 | | |
| | | | | | | 170 | 12.7 | | |
| Comparative Example 28 | 1000 | 3.8 | — | — | — | 20 | 12.0 | 7.15 | 35.5 |
| | | | | | | 50 | 12.1 | | |
| | | | | | | 80 | 12.2 | | |
| | | | | | | 100 | 12.1 | | |
| | | | | | | 130 | 12.3 | | |
| | | | | | | 150 | 13.0 | | |
| | | | | | | 170 | 14.5 | | |

(Note)
*Completely alloyed steel powder of Co—Ni—Mo—Cu type
**Surface treatment agents are represented by the symbol shown in Table 16.
***Lubricant includes thermoplastic resins, thermoplastic elastomers, materials having layer crystal structure, represented by the symbol shown in Table 17.

TABLE 29

| | Completely* alloyed steel powder (g) | Graphite (g) | Surface** treatment agent (wt % to steel powder) | Lubricant*** (wt % to steel powder) | Secondary Lubricant (wt % to steel powder) | Measurement temperature (° C.) | Flow rate (sec/100 g) | Compactibility 180° C., 7 ton/cm$^2$ Green density (Mg/m$^3$) | Compactibility 180° C., 7 ton/cm$^2$ Ejection force (MPa) |
|---|---|---|---|---|---|---|---|---|---|
| Example 75 | 1000 | 4.0 | f (0.03) | x (0.2) | Lithium stearate (0.2) + Lithium hydroxystearate (0.05) + Calcium laurate (0.05) | 20 | 10.8 | 7.28 | 22.3 |
| | | | | | | 50 | 10.8 | | |
| | | | | | | 80 | 10.9 | | |
| | | | | | | 100 | 10.9 | | |
| | | | | | | 130 | 11.0 | | |
| | | | | | | 150 | 11.3 | | |
| | | | | | | 170 | 12.5 | | |
| Comparative Example 29 | 1000 | 4.0 | — | x (0.2) | Lithium stearate (0.2) + Lithium hydroxystearate (0.05) + Calcium laurate (0.05) | 20 | 11.7 | 7.25 | 26.1 |
| | | | | | | 50 | 11.7 | | |
| | | | | | | 80 | 11.8 | | |
| | | | | | | 100 | 11.7 | | |
| | | | | | | 130 | 11.8 | | |
| | | | | | | 150 | 12.1 | | |
| | | | | | | 170 | 13.3 | | |
| Comparative Example 30 | 1000 | 4.0 | — | — | — | 20 | 12.4 | 7.21 | 38.9 |
| | | | | | | 50 | 12.4 | | |
| | | | | | | 80 | 12.5 | | |
| | | | | | | 100 | 12.5 | | |
| | | | | | | 130 | 12.8 | | |
| | | | | | | 150 | 13.9 | | |
| | | | | | | 170 | 14.6 | | |

(Note)

*Completely alloyed steel powder of Ni—Cu—Mo type

**Surface treatment agents are represented by the symbol shown in Table 16.

***Lubricant includes thermoplastic resins, thermoplastic elastomers, materials having layer crystal structure, represented by the symbol shown in Table 17.

TABLE 30

| | Partially* alloyed steel powder (g) | Graphite (g) | Surface** treatment agent (wt % to steel powder) | Secondary Lubricant (wt % to steel powder) | Measurement temperature (° C.) | Flow rate (sec/100 g) | Compactibility 150° C., 7 ton/cm$^2$ Green density (Mg/m$^3$) | Compactibility 150° C., 7 ton/cm$^2$ Ejection force (MPa) |
|---|---|---|---|---|---|---|---|---|
| Example 76 | 1000 | 3.0 | e (0.03) | Lithium stearate (0.2) + Calcium laurate (0.1) | 20 | 11.4 | 7.36 | 18.7 |
| | | | | | 50 | 11.4 | | |
| | | | | | 80 | 11.5 | | |
| | | | | | 100 | 11.4 | | |
| | | | | | 130 | 11.5 | | |
| | | | | | 150 | 11.7 | | |
| Comparative Example 31 | 1000 | 3.0 | — | Lithium stearate (0.2) + Calcium laurate (0.1) | 20 | 12.2 | 7.33 | 22.5 |
| | | | | | 50 | 12.3 | | |
| | | | | | 80 | 12.4 | | |
| | | | | | 100 | 12.3 | | |
| | | | | | 130 | 12.5 | | |
| | | | | | 150 | 12.7 | | |
| Comparative Example 32 | 1000 | 3.0 | — | — | 20 | 12.7 | 7.28 | 35.2 |
| | | | | | 50 | 12.8 | | |
| | | | | | 80 | 12.9 | | |
| | | | | | 100 | 12.8 | | |
| | | | | | 130 | 13.0 | | |
| | | | | | 150 | 13.2 | | |

(Note)

**Surface treatment agents are represented by the symbol shown in Table 16.

TABLE 31

| | Partially* alloyed steel powder (g) | Graphite (g) | Surface** treatment agent (wt % to steel powder) | Secondary Lubricant (wt % to steel powder) | Measurement temperature (° C.) | Flow rate (sec/100 g) | Compactibility 150° C., 7 ton/cm² Green density (Mg/m³) | Ejection force (MPa) |
|---|---|---|---|---|---|---|---|---|
| Example 77 | 1000 | 3.0 | f (0.03) | Lithium stearate (0.2) | 20 | 11.5 | 7.37 | 19.6 |
| | | | | | 50 | 11.5 | | |
| | | | | | 80 | 11.6 | | |
| | | | | | 100 | 11.5 | | |
| | | | | | 130 | 11.6 | | |
| | | | | | 150 | 11.8 | | |
| Comparative Example 33 | 1000 | 3.0 | — | Lithium stearate (0.2) | 20 | 12.3 | 7.36 | 27.5 |
| | | | | | 50 | 12.4 | | |
| | | | | | 80 | 12.5 | | |
| | | | | | 100 | 12.4 | | |
| | | | | | 130 | 12.6 | | |
| | | | | | 150 | 12.8 | | |
| Comparative Example 34 | 1000 | 3.0 | — | — | 20 | 12.9 | 7.28 | 38.6 |
| | | | | | 50 | 13.0 | | |
| | | | | | 80 | 13.1 | | |
| | | | | | 100 | 13.0 | | |
| | | | | | 130 | 13.2 | | |
| | | | | | 150 | 13.4 | | |

(Note)
**Surface treatment agents are represented by the symbol shown in Table 16.

What is claimed is:

1. An iron-based powder composition for powder metallurgy having higher flowability and higher compactibility, comprising an iron-based powder, a lubricant, and an alloying powder; at least one of the iron-based powder, the lubricant, and the alloying powder being coated with at least one surface treatment agent selected from the group of surface treatment agents below:

organoalkoxysilanes, organosilazanes, titanate coupling agents, fluorine-containing silicon silane coupling agents.

2. An iron-based powder composition for powder metallurgy having higher flowability and higher compactibility, comprising an iron-based powder, a lubricant fixed by melting to the iron-based powder, an alloying powder fixed to the iron-based powder by the lubricant, and a free lubricant powder;

at least one of the iron-based powder, the lubricant, and the alloying powder being coated with at least one surface treatment agent selected from the group of surface treatment agents below:

organoalkoxysilanes, organosilazanes, titanate coupling agents, fluorine-containing silicon silane coupling agents.

3. An iron-based powder composition for powder metallurgy having higher flowability and higher compactibility, comprising an iron-based powder, a lubricant fixed by melting to the iron-based powder, an alloying powder fixed to the iron-based powder by the lubricant, and a free lubricant powder;

at least one of the iron-based powder, the lubricant, and the alloying powder being coated with at least one surface treatment agent selected from the group of surface treatment agents consisting of a mineral oil and a silicone fluid.

4. The iron-based powder composition for powder metallurgy having higher flowability and higher compactibility according to claim 3, wherein the mineral oil is an alkylbenzene.

5. The iron-based powder composition for powder metallurgy having higher flowability and higher compactibility according to claim 1 or 2, wherein the organoalkoxysilane is one or more organoalkoxysilanes having a substituted or unsubstituted organic group.

6. The iron-based powder composition for powder metallurgy having higher flowability and higher compactibility according to claim 5, wherein the substituent of the organic group is selected from acryl, epoxy, and amino.

7. The iron-based powder composition for powder metallurgy having higher flowability and higher compactibility according to claim 1, wherein the lubricant is a fatty acid amide and/or a metal soap.

8. The iron-based powder composition for powder metallurgy having higher flowability and higher compactibility according to claim 7, wherein one or more material selected from the group of inorganic materials having a layer crystal structure, organic materials having a layer crystal structure, thermoplastic resins, and thermoplastic elastomers are further added as the lubricant.

9. The iron-based powder composition for powder metallurgy having higher flowability and higher compactibility according to claim 7 or 8, wherein a fatty acid is further added as the lubricant.

10. The iron-based powder composition for powder metallurgy having higher flowability and higher compactibility according to claim 7, wherein the fatty acid amide is a fatty acid monoamide and/or a fatty acid bisamide.

11. The iron-based powder composition for powder metallurgy having higher flowability and higher compactibility according to claim 8, wherein the inorganic compound having a layer crystal structure is one or more compound selected from the group of graphite, carbon fluoride, and $MoS_2$.

12. The iron-based powder composition for powder metallurgy having higher flowability and higher compactibility according to claim 8, wherein the organic material having a layer crystal structure is a melamine-cyanuric acid adduct and/or a β-alkyl-N-alkylaspartic acid.

13. The iron-based powder composition for powder metallurgy having higher flowability and higher compactibility according to claim 8, wherein the thermoplastic resin is selected from polystyrene, nylon, polyethylene, and fluoroplastics in a powder state of a particle diameter of 30 μm or less.

14. The iron-based powder composition for powder metallurgy having higher flowability and higher compactibility according to claim 8, wherein the thermoplastic elastomer is in a powder state having a particle diameter of 30 $\mu$m or less.

15. The iron-based powder composition for powder metallurgy having higher flowability and higher compactibility according to claim 8 wherein the thermoplastic elastomer is one or more selected from the group of styrene block copolymer (SBC), thermoplastic elastomer olefin (TEO), thermoplastic elastomer polyamide (TPAE), and thermoplastic elastomer silicone.

16. The iron-based powder composition for powder metallurgy comprising an iron-based powder, a lubricant fixed by melting to the iron-based powder, an alloying powder fixed to the iron-based powder by the lubricant, and a free lubricant powder;

at least one of the iron-based powder, the lubricant, and the alloying powder being coated with at least one surface treatment agent selected from the group of surface treatment agents below;

organoalkoxysilanes, organosilazanes, titanate coupling agents, fluorine-containing silicon silane coupling agents, wherein the free lubricant powder is present in an amount of not less than 25% by weight, but not more than 80% by weight.

* * * * *